US008522867B2

(12) United States Patent
Yeh et al.

(10) Patent No.: US 8,522,867 B2
(45) Date of Patent: Sep. 3, 2013

(54) WELL FLOW CONTROL SYSTEMS AND METHODS

(75) Inventors: Charles S. Yeh, Spring, TX (US); Bruce A. Dale, Sugar Land, TX (US); Scott R. Clingman, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 379 days.

(21) Appl. No.: 13/062,881

(22) PCT Filed: Nov. 3, 2008

(86) PCT No.: PCT/US2008/082248

§ 371 (c)(1),
(2), (4) Date: Mar. 8, 2011

(87) PCT Pub. No.: WO2010/050991

PCT Pub. Date: May 6, 2010

(65) Prior Publication Data

US 2011/0192602 A1 Aug. 11, 2011

(51) Int. Cl.
*E21B 43/08* (2006.01)

(52) U.S. Cl.
USPC ..... 166/235; 166/276; 166/278; 166/236

(58) Field of Classification Search
USPC ..... 166/235, 276, 278, 236
See application file for complete search history.

(56) References Cited

U.S. PATENT DOCUMENTS

| | | | |
|---|---|---|---|
| 1,473,644 | A | 11/1923 | Rodrigo |
| 1,594,788 | A | 1/1925 | McLaughlin et al. |
| 1,620,412 | A | 3/1927 | Tweeddale |
| 2,681,111 | A | 6/1954 | Thompson |
| 3,173,488 | A | 3/1965 | Rensvold |
| 3,357,564 | A | 12/1967 | Medford, Jr. et al. |
| 3,556,219 | A | 1/1971 | Meldau |
| 4,064,938 | A | 12/1977 | Fast |
| 4,428,428 | A | 1/1984 | Smyrl et al. |
| 4,657,079 | A | 4/1987 | Nagaoka |
| 4,771,829 | A | 9/1988 | Sparlin |
| 4,818,403 | A | 4/1989 | Nagaoka |
| 4,945,991 | A | 8/1990 | Jones |
| 4,977,958 | A | 12/1990 | Miller |
| 5,004,049 | A | 4/1991 | Arterbury |
| 5,069,279 | A | 12/1991 | Nagaoka |
| 5,076,359 | A | 12/1991 | Yeh |
| 5,082,052 | A | 1/1992 | Jones et al. |
| 5,083,614 | A | 1/1992 | Branch |
| 5,113,935 | A | 5/1992 | Jones et al. |
| 5,115,864 | A | 5/1992 | Gaidry et al. |
| 5,161,613 | A | 11/1992 | Jones |

(Continued)

*Primary Examiner* — Daniel P Stephenson
*Assistant Examiner* — Marwan Bashir
(74) *Attorney, Agent, or Firm* — ExxonMobil Upstream Research Company

(57) ABSTRACT

Flow control systems and methods for use in hydrocarbon well operations include a tubular and a flow control apparatus. The tubular defines a well annulus and includes an outer member defining a flow conduit. Fluid communication between the well annulus and the flow conduit is provided by permeable portion(s) of the outer member. The flow control apparatus is disposed within the flow conduit and comprises conduit-defining and chamber-defining structural members. The conduit-defining structural member(s) is configured to divide the flow conduit into at least two flow control conduits. The chamber-defining structural member(s) is configured to divide at least one of the at least two flow control conduits into at least two flow control chambers. Each of the flow control chambers has at least one inlet and one outlet, each of which is adapted to allow fluid flow therethrough and to retain particles larger than a predetermined size.

30 Claims, 14 Drawing Sheets

(56) References Cited

U.S. PATENT DOCUMENTS

| | | | |
|---|---|---|---|
| 5,161,618 | A | 11/1992 | Jones et al. |
| 5,165,476 | A | 11/1992 | Jones |
| 5,209,296 | A | 5/1993 | Donlon |
| 5,222,556 | A | 6/1993 | Donlon |
| 5,246,158 | A | 9/1993 | Nagaoka et al. |
| 5,307,984 | A | 5/1994 | Nagaoka et al. |
| 5,311,942 | A | 5/1994 | Nagaoka |
| 5,318,119 | A | 6/1994 | Lowry et al. |
| 5,332,045 | A | 7/1994 | Ross et al. |
| 5,333,688 | A | 8/1994 | Jones et al. |
| 5,333,689 | A | 8/1994 | Jones et al. |
| 5,341,880 | A | 8/1994 | Thorstensen et al. |
| 5,355,949 | A | 10/1994 | Sparlin et al. |
| 5,390,966 | A | 2/1995 | Cox et al. |
| 5,392,850 | A | 2/1995 | Cornette et al. |
| 5,396,954 | A | 3/1995 | Brooks |
| 5,404,945 | A | 4/1995 | Head et al. |
| 5,415,202 | A | 5/1995 | Shiffler et al. |
| 5,417,284 | A | 5/1995 | Jones |
| 5,419,394 | A | 5/1995 | Jones |
| 5,435,391 | A | 7/1995 | Jones |
| 5,450,898 | A | 9/1995 | Sparlin et al. |
| 5,476,143 | A | 12/1995 | Sparlin et al. |
| 5,505,260 | A | 4/1996 | Andersen et al. |
| 5,515,915 | A | 5/1996 | Jones et al. |
| 5,560,427 | A | 10/1996 | Jones |
| 5,588,487 | A | 12/1996 | Bryant |
| 5,642,781 | A | 7/1997 | Richard |
| 5,664,628 | A | 9/1997 | Koehler et al. |
| 5,690,175 | A | 11/1997 | Jones |
| 5,787,980 | A | 8/1998 | Sparlin et al. |
| 5,803,179 | A | 9/1998 | Echols et al. |
| 5,842,516 | A | 12/1998 | Jones |
| 5,848,645 | A | 12/1998 | Jones |
| 5,868,200 | A | 2/1999 | Bryant et al. |
| 5,881,809 | A | 3/1999 | Gillespie et al. |
| 5,890,533 | A | 4/1999 | Jones |
| 5,896,928 | A | 4/1999 | Coon |
| 5,909,774 | A | 6/1999 | Griffith et al. |
| 5,934,376 | A | 8/1999 | Nguyen et al. |
| 6,003,600 | A | 12/1999 | Nguyen et al. |
| 6,112,817 | A | 9/2000 | Voll et al. |
| 6,125,932 | A | 10/2000 | Hamid et al. |
| 6,220,345 | B1 | 4/2001 | Jones et al. |
| 6,223,906 | B1 | 5/2001 | Williams |
| 6,227,303 | B1 | 5/2001 | Jones |
| 6,230,803 | B1 | 5/2001 | Morton et al. |
| 6,298,916 | B1 | 10/2001 | Tibbles et al. |
| 6,302,207 | B1 | 10/2001 | Nguyen et al. |
| 6,405,800 | B1 | 6/2002 | Walker et al. |
| 6,409,219 | B1 | 6/2002 | Broome et al. |
| 6,427,775 | B1 | 8/2002 | Dusterhoft et al. |
| 6,446,722 | B2 | 9/2002 | Nguyen et al. |
| 6,464,261 | B1 | 10/2002 | Dybevik et al. |
| 6,481,494 | B1 | 11/2002 | Dusterhoft et al. |
| 6,494,265 | B2 | 12/2002 | Wilson et al. |
| 6,513,599 | B1 | 2/2003 | Bixenman et al. |
| 6,516,881 | B2 | 2/2003 | Hailey, Jr. |
| 6,540,022 | B2 | 4/2003 | Dusterhoft et al. |
| 6,557,634 | B2 | 5/2003 | Hailey, Jr. et al. |
| 6,575,245 | B2 | 6/2003 | Hurst et al. |
| 6,575,251 | B2 | 6/2003 | Watson et al. |
| 6,581,689 | B2 | 6/2003 | Hailey, Jr. |
| 6,588,506 | B2 | 7/2003 | Jones |
| 6,601,646 | B2 | 8/2003 | Streich et al. |
| 6,619,397 | B2 | 9/2003 | Coon et al. |
| 6,622,794 | B2 | 9/2003 | Zisk, Jr. |
| 6,644,406 | B1 | 11/2003 | Jones |
| 6,666,274 | B2 | 12/2003 | Hughes |
| 6,695,067 | B2 | 2/2004 | Johnson et al. |
| 6,698,518 | B2 | 3/2004 | Royer et al. |
| 6,715,544 | B2 | 4/2004 | Gillespie et al. |
| 6,749,023 | B2 | 6/2004 | Nguyen et al. |
| 6,749,024 | B2 | 6/2004 | Bixenman |
| 6,752,206 | B2 | 6/2004 | Watson et al. |
| 6,752,207 | B2 | 6/2004 | Donos |
| 6,755,245 | B2 | 6/2004 | Nguyen et al. |
| 6,789,623 | B2 | 9/2004 | Hill, Jr. et al. |
| 6,814,139 | B2 | 11/2004 | Hejl et al. |
| 6,817,410 | B2 | 11/2004 | Wetzel et al. |
| 6,830,104 | B2 | 12/2004 | Nguyen et al. |
| 6,848,510 | B2 | 2/2005 | Bixenman et al. |
| 6,857,475 | B2 | 2/2005 | Johnson |
| 6,923,262 | B2 | 8/2005 | Broome et al. |
| 6,935,432 | B2 | 8/2005 | Nguyen |
| 6,983,796 | B2 | 1/2006 | Bayne et al. |
| 6,986,390 | B2 | 1/2006 | Doanne et al. |
| 6,997,263 | B2 | 2/2006 | Campbell et al. |
| 7,048,061 | B2 | 5/2006 | Bode et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,104,324 | B2 | 9/2006 | Wetzel et al. |
| 7,152,677 | B2 | 12/2006 | Parlar et al. |
| 7,207,383 | B2 | 4/2007 | Hurst et al. |
| 7,234,518 | B2 | 6/2007 | Smith |
| 7,243,724 | B2 | 7/2007 | McGregor et al. |
| 7,252,142 | B2 | 8/2007 | Brezinski et al. |
| 7,264,061 | B2 | 9/2007 | Dybevik et al. |
| 7,370,700 | B2 | 5/2008 | Hurst et al. |
| 7,383,886 | B2 | 6/2008 | Dybevik et al. |
| 7,431,058 | B2 | 10/2008 | Holting |
| 7,464,752 | B2 | 12/2008 | Dale et al. |
| 7,870,898 | B2 | 1/2011 | Yeh et al. |
| 2003/0159825 | A1 | 8/2003 | Hurst et al. |
| 2003/0173075 | A1 | 9/2003 | Morvant et al. |
| 2003/0189010 | A1 | 10/2003 | Wilhelm |
| 2004/0007829 | A1 | 1/2004 | Ross |
| 2004/0140089 | A1 | 7/2004 | Gunneroed |
| 2005/0039917 | A1 | 2/2005 | Hailey, Jr. |
| 2005/0045329 | A1 | 3/2005 | Wetzel et al. |
| 2005/0067170 | A1 | 3/2005 | Richard |
| 2005/0082060 | A1 | 4/2005 | Ward et al. |
| 2005/0178562 | A1 | 8/2005 | Livingstone |
| 2007/0114020 | A1 | 5/2007 | Brekke |
| 2008/0006402 | A1 | 1/2008 | Russell |
| 2008/0041577 | A1 | 2/2008 | Baaijens et al. |

WELL FLOW CONTROL SYSTEMS AND METHODS

CROSS REFERENCE TO RELATED APPLICATIONS

This application is the National Stage of International Application No. PCT/US08/82248, filed 3 Nov. 2008.

FIELD

The present disclosure relates generally to systems and methods for recovering hydrocarbons from subsurface reservoirs. More particularly, the present disclosure relates to systems and methods for controlling the flow of undesired particulates from subsurface reservoirs through well equipment to the surface.

BACKGROUND

This section is intended to introduce the reader to various aspects of art, which may be associated with embodiments of the present invention. This discussion is believed to be helpful in providing the reader with information to facilitate a better understanding of particular techniques of the present invention. Accordingly, it should be understood that these statements are to be read in this light, and not necessarily as admissions of prior art.

Hydrocarbon production from subterranean reservoirs commonly includes a well completed in either a cased-hole or an open-hole condition. In cased-hole applications, a well casing is placed in the well and the annulus between the casing and the well is filled with cement. Perforations are made through the casing and the cement into the production zones to allow formation fluids (such as, hydrocarbons) to flow from the production zones into the conduit within the casing. Additionally or alternatively, the fluid flow may be from the conduit within the casing into the subterranean formation, such as during injection operations. While the discussion herein will generally refer to production operations and fluid flow in the production direction, the principles and technologies described herein apply by analogy to fluid flow in the injection direction. A production string (or, an injection string), consisting primarily of one or more tubulars, is then placed inside the casing, creating an annulus between the casing and the production string. Formation fluids flow into the annulus and then into the production string to the surface through tubulars associated with the production string. In open-hole applications, the production string is directly placed inside the well without casing or cement. Formation fluids flow into the annulus between the formation and the production string and then into the production string to surface.

Modern hydrocarbon wells generally pass through or into multiple subterranean formation types and are continually reaching ever greater depths and/or lengths (such as for extended reach horizontal wells). Additionally, it is common for hydrocarbon wells to extend through multiple reservoirs over the life of the well. In some implementations, the well may extend through multiple reservoirs during any given production operation. Additionally or alternatively, a well may extend though a single reservoir that operates more like multiple reservoirs due to the variations of formation properties within the reservoir and/or the size of the reservoir.

The ever increasing complexity of modern hydrocarbon production operations often necessitates increasingly complex well constructions and completions. The construction of a hydrocarbon well typically includes modeling the subsurface to estimate the formation and reservoir properties. The modeling typically includes inputs from geologic and seismic data as well as data from test wells and/or adjacent wells in the field. These modeling efforts enable the scientists and engineers to identify a preferred location for the well and preferred drilling parameters for the drilling of the well. For example, the rate of penetration, the mud weight, and several parameters related to the drilling operation can affect the long-term operation of the well. While the models and the technology underlying the models are continually evolving, the scientists and engineers are left with an approximation based on previously collected data. The drilling operation is a dynamic, multi-parameter operation where changes in any one parameter could impact any of several parameters over the life of the well.

While the drilling plan can have significant impact on the operation of the well during its life, the completion of the well is often considered determinative of how a given well, once drilled, will operate. As used herein, completion is used generically to refer to procedures and equipment designed to allow a well to be operated safely and efficiently. The point at which the completion process begins may depend on the type and design of well. However, there are many options applied or actions performed during the construction phase of a well that have significant impact on the productivity of the well. Accordingly, completion plans are often prepared prior to the drilling operations based on the models and collected data. The completion plans are often updated based on data collected during the drilling operations to further optimize the operation of the well (whether injection or production).

Despite the accuracy or completeness of the data available when the completion plan is finalized and the completion is implemented in the well, the well's evolution, the reservoir's evolution, and the formation's evolution during the life of the well make most completions inadequate for the extended life of the well. Accordingly, sophisticated work-over procedures have been developed to allow operators to change the completion of a well after production and/or injection operations have begun. Additionally, several efforts have been made to develop intelligent or flexible completions that can be changed during the life of the well without requiring the withdrawal of the completion equipment from the well. Many of these intelligent completions require mechanical equipment downhole that is controlled from the surface between two or more configurations. While the adaptable completion concept is sound, the harsh conditions of the well and the long life of the well generally complicate efforts to manipulate these multi-configuration mechanical devices deep in the well. Moreover, the requirement of these systems to be activated from the surface creates a time delay while the results of the changed downhole condition increasingly manifests itself at the surface and is observed at the surface, and then the control signal can be sent to the downhole equipment that has to transition between configurations.

When producing fluids from subterranean formations, especially poorly consolidated formations or formations weakened by increasing downhole stress due to well excavation and fluids withdrawal, it is possible to produce solid material (for example, sand) along with the formation fluids. This solids production may reduce well productivity, damage subsurface equipment, and add handling cost on the surface. Controlling the production of solids or particles is one example of the objectives of the completion equipment and procedures. Several downhole solid, particularly sand, control methods are currently being practiced by the industry and are shown in FIGS. 1(*a*), 1(*b*), 1(*c*) and 1(*d*). In FIG. 1(*a*), the production string or pipe (not shown) typically includes a sand screen or sand control device 1 around its outer periphery, which is placed adjacent to each production zone. The sand screen prevents the flow of sand from the production zone 2 into the production string (not shown) inside the sand screen 1. Slotted or perforated liners can also be utilized as sand screens or sand control devices. FIG. 1(*a*) is an example of a screen-only completion with no gravel pack present.

One of the most commonly used techniques for controlling sand production is gravel packing in which sand or other particulate matter is deposited around the production string or well screen to create a downhole filter. FIGS. 1(*b*) and 1(*c*) are examples of cased-hole and open-hole gravel packs, respectively. FIG. 1(*b*) illustrates the gravel pack 3 outside the screen 1, the well casing 5 surrounding the gravel pack 3, and cement 8 around the well casing 5. Typically, perforations 7 are shot through the well casing 5 and cement 8 into the production zone 2 of the subterranean formations around the well. FIG. 1(*c*) illustrates an open-hole gravel pack wherein the well has no casing and the gravel pack material 3 is deposited around the well sand screen 1.

A variation of a gravel pack involves pumping the gravel slurry at pressures high enough so as to exceed the formation fracture pressure (frac pack). FIG. 1(*d*) is an example of a Frac-Pack. The well screen 1 is surrounded by a gravel pack 3, which is contained by a well casing 5 and cement 8. Perforations 6 in the well casing allow gravel to be distributed outside the well to the desired interval. The number and placement of perforations are chosen to facilitate effective distribution of the gravel packing outside the well casing to the interval that is being treated with the gravel-slurry.

Flow impairment during production from subterranean formations can result in a reduction in well productivity or complete cessation of well production. This loss of functionality may occur for a number of reasons, including but not limited to: 1) migration of fines, shales, or formation sands; 2) inflow or coning of unwanted fluids (such as, water or gas); 3) formation of inorganic or organic scales; 4) creation of emulsions or sludges; 5) accumulation of drilling debris (such as, mud additives and filter cake); 6) excessive inflow of particles, such as sand, into and through the production tubulars due to mechanical damage to sand control screen and/or due to incomplete or ineffective gravel pack implementations; 7) and mechanical failure due to borehole collapse, reservoir compaction/subsidence, or other geomechanical movements.

There are several examples of technology that has been developed in efforts to address these problems. Examples of such technologies can be found in numerous U.S. patents, including those mentioned briefly here. For example, U.S. Pat. No. 6,622,794 discloses a screen equipped with a flow control device, which includes multiple apertures and channels to direct and restrict flow. The fluid flow through the screen is disclosed as being reduced by controlling downhole apertures from the surface between fully opened and completely closed positions. U.S. Pat. No. 6,619,397 discloses a tool for zone isolation and flow control in horizontal wells. The tool is composed of blank base pipes, screens with closeable ports on the base pipe, and conventional screens positioned in an alternating manner. The closeable ports allow complete gravel pack over the blank base pipe section, flow shutoff for zone isolation, and selective flow control. U.S. Pat. No. 5,896,928 discloses a flow control device placed downhole with or without a screen. The device has a labyrinth which provides a tortuous flow path or helical restriction. The level of restriction in each labyrinth is controlled from the surface by adjusting a sliding sleeve so that flow from each perforated zone (for example, water zone, oil zone) can be controlled. U.S. Pat. No. 5,642,781 discloses a well screen jacket composed of overlapped members wherein the openings allow fluid flow through alternate contraction, expansion and provide fluid flow direction change in the well (or multi-passage). Such design may mitigate solids plugging of screen jacket openings by establishing both filtering and fluid flow momentum advantages.

Numerous other examples can be identified. However, current industry well designs and completions plans include little, if any, redundancy in the event of problems or failures resulting in flow impairment. In many instances, the ability of a well to produce at or near its design capacity is sustained by only a "single" barrier to the impairment mechanism (for example, a single screen for ensuring sand control). In many instances, the utility of the well may be compromised by impairment occurring in the single barrier. As indicated above, flow impairment may occur by a variety of mechanisms and various efforts have been made to address these mechanisms, including efforts to provide redundant barriers to the impairment mechanism. However, the systems currently available fail to provide a system that provides redundancy in the prevention of two or more impairment mechanisms. For example, prevention of impairment mechanisms such as particulate inflow and particulate blockages. Therefore, overall system reliability of the presently available systems is low. Accordingly, there is a need for well completion equipment and methods to provide multiple flow pathways inside the well that provides redundant flow pathways in the event of particulate blockage, particulate inflow, or other forms of impairment.

SUMMARY

The present disclosure is directed to systems and methods for controlling fluid flow in well equipment associated with hydrocarbon wells An exemplary well flow control system includes a tubular and a flow control apparatus. The tubular is adapted to be disposed in a well to define a well annulus. The tubular has an outer member defining an internal flow conduit and at least a portion of the outer member is permeable allowing fluid communication between the well annulus and the flow conduit. The flow control apparatus is adapted to be disposed within the flow conduit of the tubular. The flow control apparatus comprises at least one conduit-defining structural member and at least one chamber-defining structural member. The at least one conduit-defining structural member is configured to divide the flow conduit into at least two flow control conduits. The at least one chamber-defining structural members is configured to divide at least one of the at least two flow control conduits into at least two flow control chambers. Each of the at least two flow control chambers has at least one inlet and at least one outlet. Each of the at least one inlet and the at least one outlet is adapted to allow fluids to flow therethrough and to retain particles larger than a predetermined size.

Implementations of flow control systems within the scope of the present invention may include several variations on the features described above. For example, fluid flow through an outlet of a flow control chamber formed in a first flow control conduit may pass into a second flow control conduit. Additionally or alternatively, the retention of particles larger than a predetermined size by the outlet may progressively increase resistance to flow through the outlet from the flow control chamber until fluid flow through the outlet is at least substantially blocked. In some implementations, the at least two flow control chambers may be disposed within the flow conduit of the tubular such that fluid flow entering through the permeable portion of the outer member passes into at least one flow control chamber. For example, the at least one inlet to the flow control chamber is provided by the permeable portion of the outer member of the tubular.

In some implementations, the at least one inlet to the flow control chamber may be adapted to retain particles of a first predetermined size and the at least one outlet from the flow control chamber may be adapted to retain particles of a second predetermined size. Additionally or alternatively, the at least one inlet and the at least one outlet of the flow control chamber are adapted to retain particles having at least substantially similar predetermined sizes. For example, the flow control chamber may be adapted to progressively retain particles larger than the predetermined size of the at least one outlet in the event that the at least one inlet is impaired. In some implementations, the at least one inlet and the at least one outlet for at least one of the flow control chambers may be fluidically offset and in fluid communication.

In some implementations of the present flow control systems, the flow within at least one of the flow control chambers may be at least substantially longitudinal and the at least one chamber-defining structural member may be disposed at least substantially transverse to the longitudinal direction. Additionally or alternatively, the flow within at least one of the flow control chambers may be at least substantially circumferential and the at least one chamber-defining structural member may be disposed at least substantially transverse to the circumferential direction. Still additionally or alternatively, the flow within at least one of the flow control chambers may be at least substantially radial and the at least one chamber-defining structural member may be disposed at least substantially transverse to the radial direction.

Exemplary implementations of the flow control apparatus may include at least one conduit-defining structural member provided by an inner tubular having permeable segments and impermeable segments. The inner tubular defines a first flow control conduit within the inner tubular and a second flow control conduit between the outer member and the inner tubular. The at least one chamber-defining structural member and the at least two flow control chambers are disposed in the second flow control conduit. Additionally or alternatively, the at least one conduit-defining structural member may be adapted to divide the flow conduit into at least three flow control conduits. In some implementations, the chamber-defining structural members may define flow control chambers in at least two of the at least three flow control conduits. In such implementations, at least one of the at least three flow control conduits may be in fluid communication with the well annulus only through one or more of the flow control chambers. In implementations having flow control chambers in two or more flow control conduits, the flow control chambers in adjacent flow control conduits may be fluidically offset and in fluid communication.

Implementations of the present flow control systems may include at least one conduit-defining structural member comprising an inner tubular having permeable segments and impermeable segments. The inner tubular may define a first flow control conduit within the inner tubular. The at least one conduit-defining structural member further comprises helically wrapped flights extending along at least a portion of the inner tubular and configured to define at least one helical flow control conduit between the outer member and the inner tubular. In such implementations, the at least one chamber-defining structural member and the at least two flow control chambers may be disposed in the at least one helical flow control conduit.

Additionally or alternatively, one or more of the at least one outlets may be adapted to be selectively opened to control fluid flow through the outlet. In some implementations, at least one of the at least two flow control chambers may include at least two outlets adapted to retain particles of different predetermined sizes. In such implementations, each of the at least two outlets may adapted to be selectively opened to fluid flow to selectively retain particles of different predetermined sizes depending on which outlet is opened.

The inlet to at least one flow control chamber may be formed in the flow control apparatus and the outlet from the at least one flow control chamber may be formed by the permeable portion of the outer member. Additionally or alternatively, the permeable portion of the outer member may provide an inlet to at least one flow control chamber and the outlet from the at least one flow control chamber may be formed in the flow control apparatus.

The present disclosure is further directed to a flow control apparatus adapted for insertion into a flow conduit of a well tubular. Exemplary flow control apparatus include at least one conduit-defining structural member and at least one chamber-defining structural member. The at least one conduit-defining structural member may be adapted to be inserted in a flow conduit of a well tubular and to divide the flow conduit into at least two flow control conduits. The at least one chamber-defining structural member may be configured to divide at least one of the at least two flow control conduits into at least two flow control chambers. The flow control apparatus further includes at least one permeable region provided in at least one of the at least one conduit-defining structural member and the at least one chamber-defining structural member. The at least one permeable region is adapted to allow fluid communication and to retain particles larger than a predetermined size. The permeable portion is provided such that fluids flowing through the at least one permeable region passes from a first flow control conduit to a second flow control conduit within the flow conduit.

Flow control apparatus within the scope of the present invention may include variations on the components described above and/or features in addition to those described above. For example, some implementations may include swellable materials disposed at least on the at least one conduit-defining structural member and adapted to at least substantially seal against the well tubular to fluidically isolate the at least two flow control conduits from each other such that flow between flow control conduits occurs at least substantially only through the at least one permeable region. Additionally or alternatively, at least two permeable regions may be provided from at least one flow control chamber. In some implementations, the at least two permeable regions may be adapted to retain particles of different predetermined sizes. Additionally or alternatively, some implementations of the present flow control apparatus may include at least one permeable region adapted to be selectively opened to control the particle size being filtered from the flow through the permeable region.

Some implementations may include at least one conduit-defining structural member provided by an inner tubular having permeable segments and impermeable segments. The inner tubular may defines a first flow control conduit within the inner tubular and a second flow control conduit outside of the inner tubular. The at least one chamber-defining structural member and the at least two flow control chambers may be disposed in the second flow control conduit. Additionally or alternatively, the at least one conduit-defining structural member may be adapted to divide the flow conduit into at least three flow control conduits. In some implementations having at least three flow control conduits the at least one chamber-defining structural member may define flow control chambers in at least two of the at least three flow control conduits. Additionally or alternatively, in implementations having flow control chambers in two or more flow control conduits, the flow control chambers in adjacent flow control conduits may be fluidically offset and in fluid communication.

Still additional or alternative implementations include at least one conduit-defining structural member comprising an inner tubular having permeable segments and impermeable segments. The inner tubular defines a first flow control conduit within the inner tubular. The at least one conduit-defining structural member may further comprise helically wrapped flights extending along at least a portion of the inner tubular and configured to define at least one helical flow control conduit outside of the inner tubular. In such implementations, the at least one chamber-defining structural member and the at least two flow control chambers may be disposed in the at least one helical flow control conduit.

The present disclosure is further directed to methods of controlling particulate flow in hydrocarbon well equipment. The methods include providing a tubular adapted for downhole use in a well. The tubular comprises an outer member defining a flow conduit and at least a portion of the outer member is permeable and allows fluid flow through the outer member. The methods further include providing at least one flow control apparatus comprising: a) at least one conduit-defining structural member adapted to be disposed in the flow conduit of the tubular and to divide the flow conduit into at least two flow control conduits; and b) at least one chamber-defining structural member configured to divide at least one of the at least two flow control conduits into at least two flow control chambers. The methods further include disposing the tubular in a well, disposing the at least one flow control apparatus in the well, and operatively coupling the at least one flow control apparatus with the tubular. The foregoing steps of providing, disposing, and coupling may occur in any suitable order such that the assembled tubular and flow control apparatus is disposed in a well. The operatively coupled tubular and at least one flow control apparatus together provide the at least two flow control conduits and the at least two flow control chambers. Moreover, each of the at least two flow control chambers has at least one inlet and at least one outlet and each of the at least one inlet and the at least one outlet is adapted to allow fluids to flow therethrough and to retain particles larger than a predetermined size. The methods further include flowing fluids through the at least one flow control apparatus and the tubular.

Similar to the above descriptions of the flow control systems and apparatus, the present flow control methods may include numerous variations and/or adaptations depending on the conditions in which the methods are implemented. For example, in some implementations, the permeable portion of the outer member may provide at least one inlet to at least one flow control chamber and the step of flowing fluids through the at least one flow control apparatus and the tubular may include flowing production fluids through the permeable portion of the outer member and through the outlets of the flow control chambers to produce hydrocarbons from the well.

Additionally or alternatively, the step of flowing fluids through the at least one flow control apparatus and the tubular may include: 1) flowing fluid into at least one flow control chamber disposed in a first flow control conduit through at least one inlet, wherein the fluid flows through the at least one inlet in a first flow direction; 2) redirecting the fluid within the flow control chamber to flow in a second flow direction; and 3) redirecting the fluid within the flow control chamber to flow in a third flow direction to pass through the at least one outlet and into a second flow control conduit. In some implementations, the second flow direction may be at least substantially longitudinal. Additionally or alternatively, the second flow direction may be at least substantially circumferential, at least substantially radial, and/or at least substantially helical.

Still additionally or alternatively, the step of flowing fluids through the at least one flow control apparatus and the tubular may comprise injecting fluids into the well. Additionally or alternatively, flowing fluids through the at least one flow control apparatus and the tubular may comprise injecting completion fluids into the well. Flowing fluids through the at least one flow control apparatus and the tubular may additionally or alternatively comprise injecting gravel pack compositions into the well.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, specific aspects and features of the present invention are described in connection with several embodiments. However, to the extent that the following description is specific to a particular embodiment or a particular use of the present techniques, it is intended to be illustrative only and merely provides a concise description of exemplary embodiments. Moreover, in the event that a particular aspect or feature is described in connection with a particular embodiment, such aspects and features may be found and/or implemented with other embodiments of the present invention where appropriate. Accordingly, the invention is not limited to the specific embodiments described below, but rather; the invention includes all alternatives, modifications, and equivalents falling within the scope of the appended claims.

As described above, completion systems and procedures are implemented in hydrocarbon wells in an effort to control flows through the downhole equipment and to promote efficient operation of the wells. Due to the variety of conditions under which wells are operated, it is impossible to sufficiently illustrate or capture the multitude of manners in which the present technology can be implemented. However, it should be understood that the technologies of the present disclosure may be implemented in production and/or injection wells, may be implemented in vertical wells, deviated wells, and/or horizontal wells, may be implemented in deep water wells, extended reach wells, arctic wells, and land-based wells, may be implemented in gas wells and in oil wells, and in virtually any other type of well and well operation that may be implemented in connection with the production of hydrocarbons. The configurations and implementations described herein are merely exemplary of the manners in which the technologies of the present disclosure may be used.

Figure 1A:
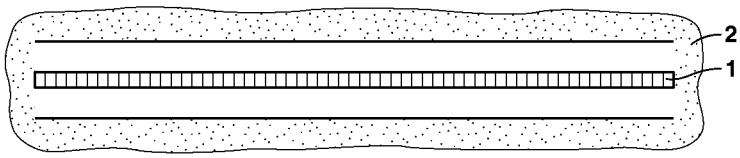
FIGS. 1A-1D are schematic illustrations of conventional sand control technologies.
Figure 1B:
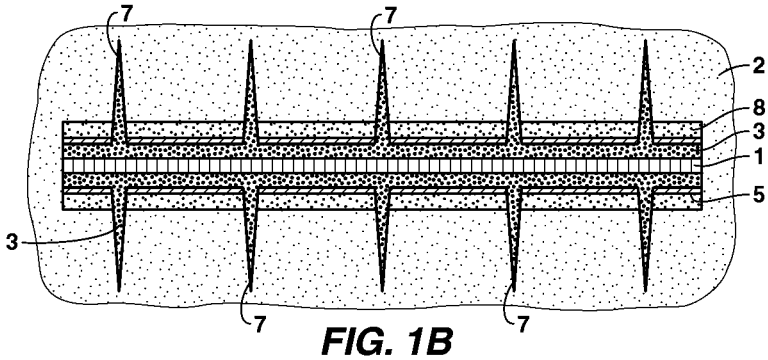
Figure 1C:
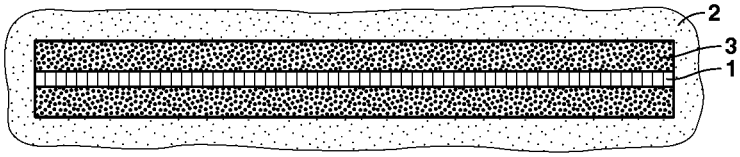
Figure 1D:
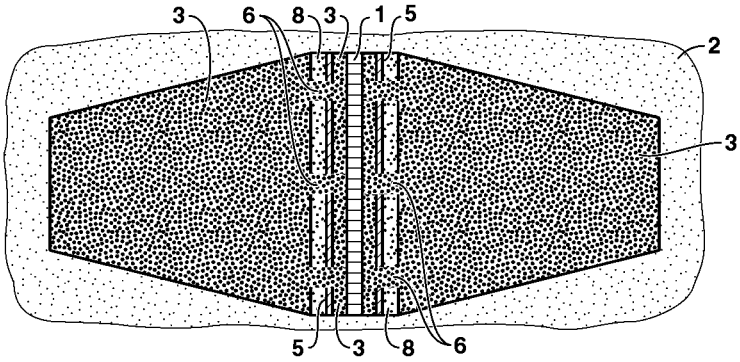
FIG. 1D (Prior Art)
Figure 2:
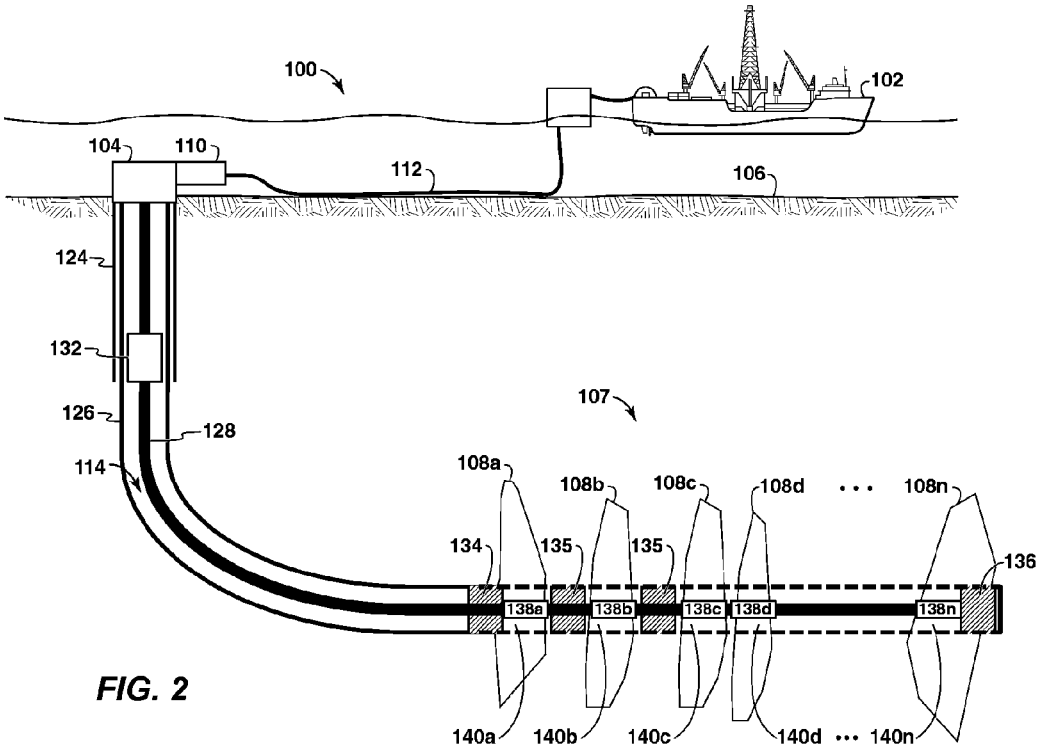
FIG. 2 is a schematic view of a well providing a context for some implementations of the present technology.

Turning now to the drawings, and referring initially to FIG. 2, an exemplary production system 100 in accordance with certain aspects of the present disclosure is illustrated. In the exemplary production system 100, a floating production facility 102 is coupled to a subsea tree 104 located on the sea floor 106. Through this subsea tree 104, the floating production facility 102 accesses one or more subsurface formations, such as subsurface formation 107, which may include multiple production intervals or zones 108*a*-108*n*, wherein number "n" is any integer number. The distinct production intervals 108*a*-108*n* may correspond to distinct reservoirs and/or to distinct formation types encompassed by a common reservoir. The production intervals 108*a*-108*n* correspond to regions or intervals of the formation having hydrocarbons (e.g., oil and/or gas) to be produced or otherwise acted upon (such as having fluids injected into the interval to move the hydrocarbons toward a nearby well, in which case the interval may be referred to as an injection interval). While FIG. 2 illustrates a floating production facility 102, it should be noted that the production system 100 is illustrated for exemplary purposes and implementations of the present technologies may be useful in the production or injection of fluids from any subsea, platform or land location.

The floating production facility 102 may be configured to monitor and produce hydrocarbons from the production intervals 108*a*-108*n* of the subsurface formation 107. The floating production facility 102 may be a floating vessel capable of managing the production of fluids, such as hydrocarbons, from subsea wells. These fluids may be stored on the floating production facility 102 and/or provided to tankers (not shown). To access the production intervals 108*a*-108*n*, the floating production facility 102 is coupled to a subsea tree 104 and control valve 110 via a control umbilical 112. The control umbilical 112 may include production tubing for providing hydrocarbons from the subsea tree 104 to the floating production facility 102, control tubing for hydraulic or electrical devices, and/or a control cable for communicating with other devices within the well 114.

To access the production intervals 108*a*-108*n*, the well 114 penetrates the sea floor 106 to a depth that interfaces with the production intervals 108*a*-108*n* at different depths (or lengths in the case of horizontal or deviated wells) within the well 114. As may be appreciated, the production intervals 108*a*-108*n*, which may be referred to as production intervals 108, may include various layers or intervals of rock that may or may not include hydrocarbons and may be referred to as zones. The subsea tree 104, which is positioned over the well 114 at the sea floor 106, provides an interface between devices within the well 114 and the floating production facility 102. Accordingly, the subsea tree 104 may be coupled to a production tubing string 128 to provide fluid flow paths and a control cable (not shown) to provide communication paths, which may interface with the control umbilical 112 at the subsea tree 104.

Within the well 114, the production system 100 may also include different equipment to provide access to the production intervals 108*a*-108*n*. For instance, a surface casing string 124 may be installed from the sea floor 106 to a location at a specific depth beneath the sea floor 106. Within the surface casing string 124, an intermediate or production casing string 126, which may extend down to a depth near the production interval 108*a*, may be utilized to provide support for walls of the well 114. The surface and production casing strings 124 and 126 may be cemented into a fixed position within the well 114 to further stabilize the well 114. Within the surface and production casing strings 124 and 126, a production tubing string 128 may be utilized to provide a flow path through the well 114 for hydrocarbons and other fluids. A subsurface safety valve 132 may be utilized to block the flow of fluids from portions of the production tubing string 128 in the event of rupture or break above the subsurface safety valve 132. Further, packers 134-136 may be utilized to isolate specific zones within the well annulus from each other. The packers 134-136 may be configured to provide fluid communication paths between surface and the sand control devices 138*a*-138*n*, while preventing fluid flow in one or more other areas, such as a well annulus.

In addition to the above equipment, other equipment, such as sand control devices 138*a*-138*n* and gravel packs 140*a*-140*n*, may be utilized to manage the flow of fluids from within the well. In particular, the sand control devices 138*a*-138*n* together with the gravel packs 140*a*-140*n* may be utilized to manage the flow of fluids and/or particles into the production tubing string 128. The sand control devices 138*a*-138*n* may include slotted liners, stand-alone screens (SAS); pre-packed screens; wire-wrapped screens, membrane screens, expandable screens and/or wire-mesh screens, while the gravel packs 140*a*-140*n* may include gravel or other suitable solid material. The sand control devices 138*a*-138*n* may also include inflow control mechanisms, such as inflow control devices (i.e. valves, conduits, nozzles, or any other suitable mechanisms), which may increase pressure loss along the fluid flow path. The gravel packs 140*a*-140*n* may be complete gravel packs that cover all of the respective sand control devices 138*a*-138*n*, or may be partially disposed around sand control devices 138*a*-138*n*. The sand control devices 138*a*-138*n* may include different components or configurations for any two or more of the intervals 108*a*-108*n* of the well to accommodate varying conditions along the length of the well. For example, the intervals 108*a*-108*b* may include a cased-hole completion and a particular configuration of sand control devices 138*a*-

138*b* while interval 108*n* may be an open-hole interval of the well having a different configuration for the sand control device 138*n*.

Conventionally, packers or other flow control mechanisms are disposed between adjacent intervals 108 to enable production in each of the zones to be independently controlled. For example, sand production into the annulus of interval 108*b* would be isolated to interval 108*b* by packers 135. FIG. 2 schematically illustrates wells 114 and particularly intervals 108 within wells are not uniform and that the reservoirs and formations come in a variety of configurations that are not easily adaptable to zonal isolation through packers. As an example, intervals 108*c* and 108*d* are schematically illustrated as adjoining in FIG. 2 and illustrated as not including a packer disposed therebetween. Adjoining intervals is one example of circumstances where zonal isolation through conventional packers is not practical. Additional examples, include wells traversing excessive numbers of different formations and/or zones such that the number of required packers would not be economically practical; wells traversing formations where the properties of the formations change gradually, yet substantially, such that the gradations can not be economically partitioned through conventional packers; and various other circumstances where the costs and/or operational risks associated with packer installation render the use of a packer impractical. As yet another example of well conditions where zonal isolation through conventional packer technology is not feasible, the conditions in each of the intervals 108 are dynamic during the operation of the well and what was initially considered to be operably a single interval may evolve to where the most efficient operation of the well would be to isolate the single interval into multiple intervals or zones for independent control. The changing characterization of an interval to require its partitioning into multiple intervals is common in well operations and is commonly accomplished through expensive and operationally risky workover procedures.

Figure 3:
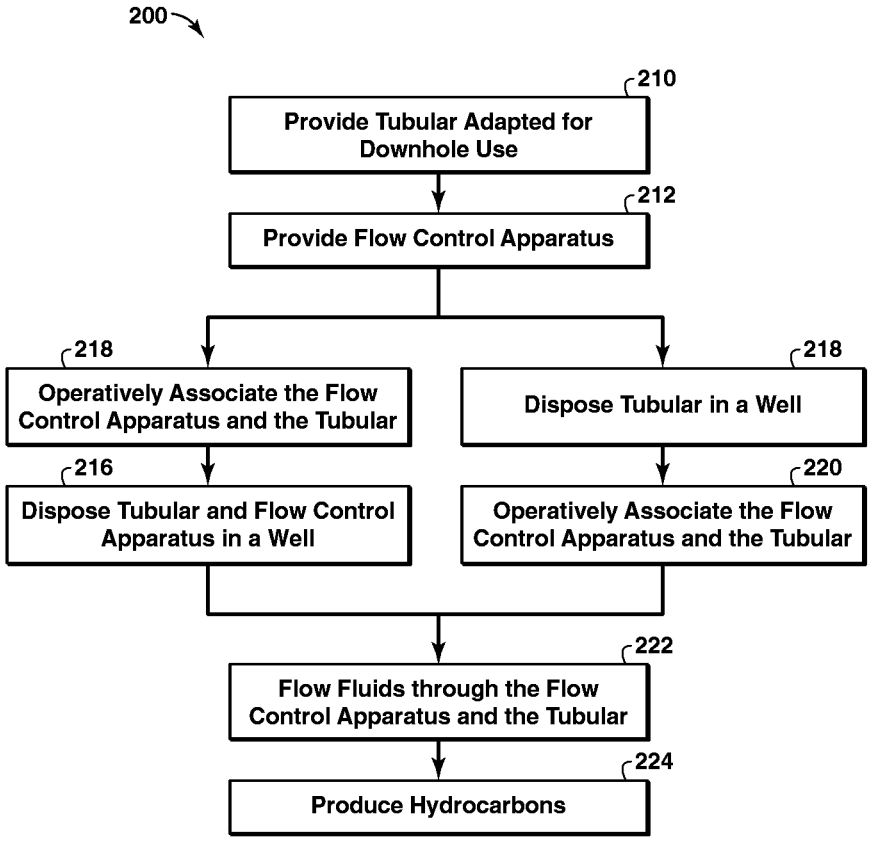
FIG. 3 is a representative flow chart of methods according to the present technology.

The technologies of the present disclosure are adapted to be disposed in a well to provide a flow control apparatus in association with a downhole tubular to provide redundant impairment resolution systems. FIG. 3 provides a schematic flow diagram 200 of methods within the scope of the present disclosure and invention. The methods of FIG. 3 begin with providing a tubular adapted for downhole use, denoted as block 210. At block 212, the method continues by providing a flow control apparatus, such as those that will be described herein. FIG. 3 illustrates that the methods of the present disclosure may be implemented in a variety of orders or sequences of steps depending on the condition of the well in which the technologies herein will be used. For example, in a new well or in a well from which the production tubing has been removed, the method 200 may include operatively associating the flow control apparatus with the tubular, at 214, followed by disposing the combined tubular and flow control apparatus in the well, such as illustrated at 216. Additionally or alternatively, the methods 200 of the present disclosure may include disposing the tubular in a well, denoted as block 218. The tubular may be disposed in the well before the flow control apparatus is provided, such as when the flow control apparatus is being installed in an existing production tubular. Alternatively, the tubular may be disposed in the well prior to associating the flow control apparatus with the tubular for other reasons. FIG. 3 illustrates at 220 that the flow control apparatus may be operatively associated with a tubular that is already disposed in a well.

The steps 210-220 of the present methods may be implemented in any suitable order or sequence so as to eventually have a flow control apparatus operatively associated with a tubular and disposed in a well. For example, the provision of the tubular may occur many years before the provision of the flow control apparatus. Similarly, the tubular may be disposed in a well long before the flow control apparatus is provided. The schematic flow chart of FIG. 3 illustrates just two of the many routes possible for arriving at the operative condition of having a flow control apparatus associated with a tubular and disposed in a well, all of which are within the scope of the present methods.

Once the flow control apparatus is disposed in the well and associated with a tubular, the methods 200 continue at 222 by flowing fluids through the flow control apparatus and the tubular. As indicated above, the fluid flow may be in the production direction (e.g., fluids flow through the tubular then through the flow control apparatus) or in the injection direction (e.g., fluids flow through the flow control apparatus then through the tubular), both being within the scope of the present methods. Finally, methods 200 produce hydrocarbons, such as indicated at 224, which hydrocarbons may be produced from the well in which the flow control apparatus is disposed or from associated wells (such as when the flow control apparatus is used in injection wells).

The discussion herein of the present systems and methods primarily describes the components and features in a production context. For example, flow control conduits and chambers are described below as having inlets and outlets associated with structural members, which inlets and outlets may be context specific. For example, a permeable portion of a structural member may provide an outlet in a production operation context and may provide an inlet in an injection operation context. Similarly, the production-centric discussion herein describes features and aspects configured to prevent sand or particles from entering a production conduit in communication with the surface. By analogy, each and all of the implementations described herein and/or those within the scope of the present invention may have labels and nomenclature suitable adapted for the injection operations. For example, in an injection operation the well annulus is the conduit in direct communication with the target (i.e., the formation) in the same manner that the production conduit is in direct communication with the target in the production operation (i.e., the surface).

Accordingly, while many of the implementations described herein include nomenclature and/or descriptions written in the production context, the present invention is not so limited. Adaptations of the present implementations for use in injection operations typically involve nothing more than changing the nomenclature used to refer to the components. In some implementations, the precise disposition of a component may change in an injection operation. However, the relative disposition of elements or components will remain with the scope of the principles and implementations described herein. More specifically, the flow control systems within the present disclosure, whether used in production operations, injection operations, treatment operations, or otherwise, include a tubular and a flow control apparatus. The tubular defines a well annulus outside thereof and includes an outer member defining a flow conduit within the outer member. At least a portion of the outer member is permeable providing fluid communication between the well annulus and the flow conduit. The flow control apparatus is disposed within the flow conduit and comprises at least one conduit-defining structural member and at least one chamber-defining structural member. The at least one conduit-defining structural member is configured to divide the flow conduit into at least two flow control conduits. The at least one chamber-defining structural member is configured to divide at least one of the at least two flow control conduits into at least two flow control chambers. Each of the at least two flow control chambers has at least one inlet and one outlet, each of which is adapted to allow fluids to flow therethrough and to retain particles larger than a predetermined size.

Figure 4:
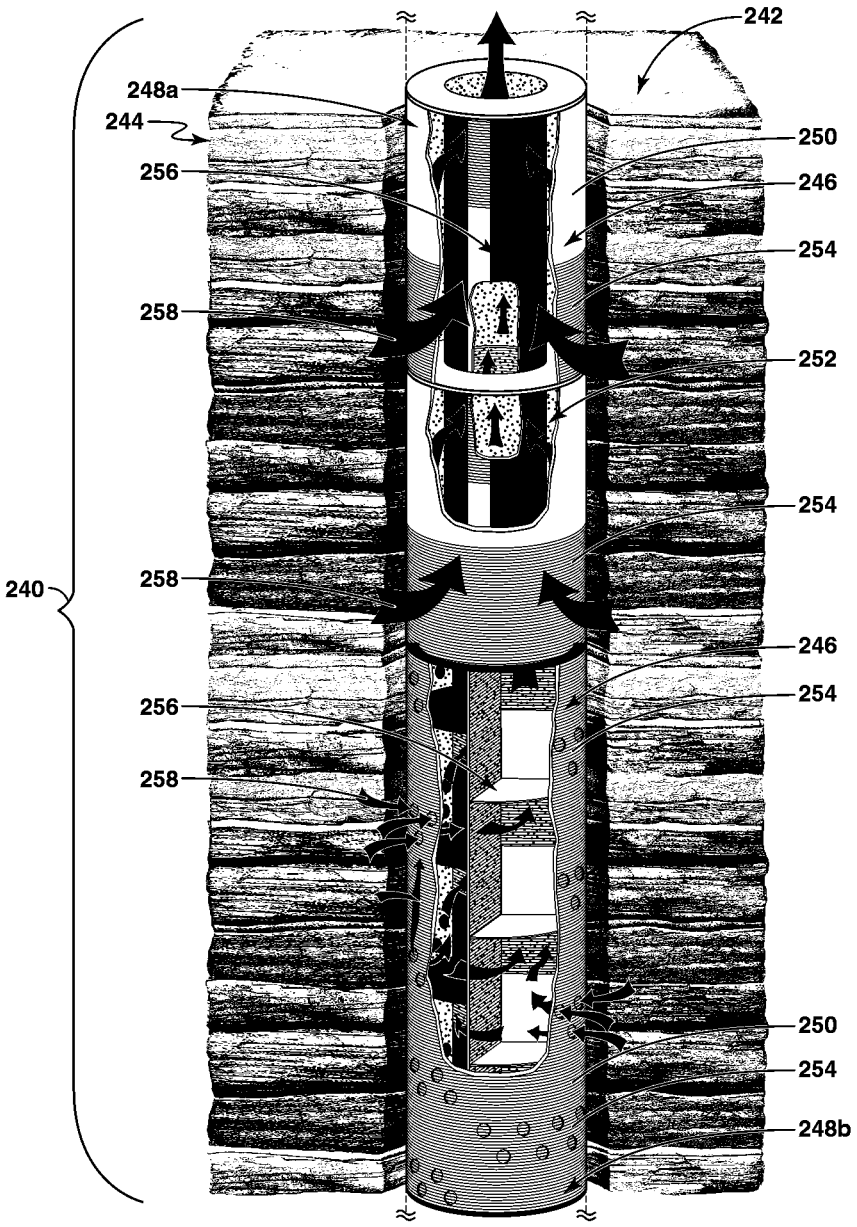
FIG. 4 is a partial cut-away view of a well incorporating implementations of the present technology.

FIG. 4 illustrates a section 240 of a well 242 in a formation 244. The well section 240 is illustrated as being a vertical section of the well 242, but is illustrated here as merely exemplary as the technology may be used in vertical, horizontal, or otherwise oriented wells. As illustrated in FIG. 4, the well 242 includes flow control systems 246 disposed in operative association with production zones of the formation 244. More specifically, FIG. 4 illustrates that the present technologies may be implemented in a variety of configurations and/or combinations of technologies to provide flow control systems 246 according to the various implementations described, taught, and suggested herein. For example, FIG. 4 illustrates that the flow control systems 246 include tubulars 248, which may be provided in a first tubular configuration 248*a* and/or in a second tubular configuration 248*b*, each of which provide permeable and impermeable sections in different manners as will be described further in connection with subsequent Figures. The tubulars 248, while different, have some elements in common. For example, each of the tubulars 248 includes an outer member 250 that defines a flow conduit 252 within the tubular. Additionally, each of the outer members 250 includes a permeable portion 254 adapted to allow fluid flow through the outer member into the flow conduit.

FIG. 4 further illustrates that the tubulars 248 include flow control apparatus 256, which may be of any of the configurations disclosed herein. Two exemplary flow control apparatus 256 are illustrated in FIG. 4. The details of the flow control apparatus' structure and functionality will be described in greater detail in connection with later Figures herein. However, as an introduction, FIG. 4 illustrates that fluid flow, represented by flow arrows 258, from the formation 244 into the tubular 248 follows a tortuous path through at least two flow control mechanisms, here represented as permeable segments associated with the outer member 248 and the flow control apparatus 256. In some implementations of the present technology, it may be preferred to use a common configuration for each of the flow control systems 246 along the length of a downhole tubular joint, along the length of a zone isolated by packers, and/or along the length of an entire operative portion of a downhole string. In other implementations, such as illustrated in FIG. 4, the characteristics of the well, the formation, and/or the reservoir may suggest the use of different flow control system configurations in a single well. For example, as illustrated schematically in FIG. 2, it is possible that two production intervals, such as zones 108*c* and 108*d*, are sufficiently close together that zonal isolation through conventional packers is not practical. The different zones may include formations having different characteristics requiring differing completions for optimal operation. A configuration such as shown in FIG. 4 where different flow control system configurations are disposed adjacent to each other may allow the differing intervals to be completed, and flows therefrom to be controlled, differently without requiring packers disposed between intervals. Similarly, the use of multiple flow control system configurations may be suitable in a variety of other common field conditions.

Figure 5A:
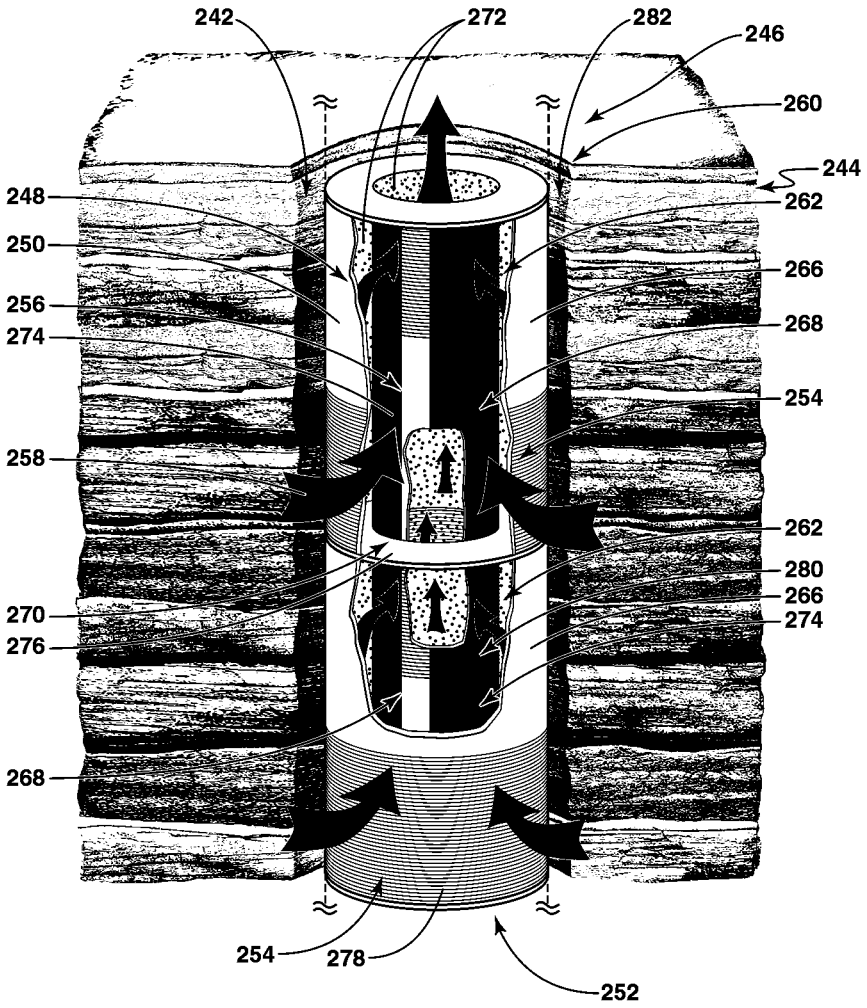
FIGS. 5A and 5B are partial cut-away views of a flow control system according to the present technology in a first operational condition and a second operational condition, respectively.
Figure 5B:
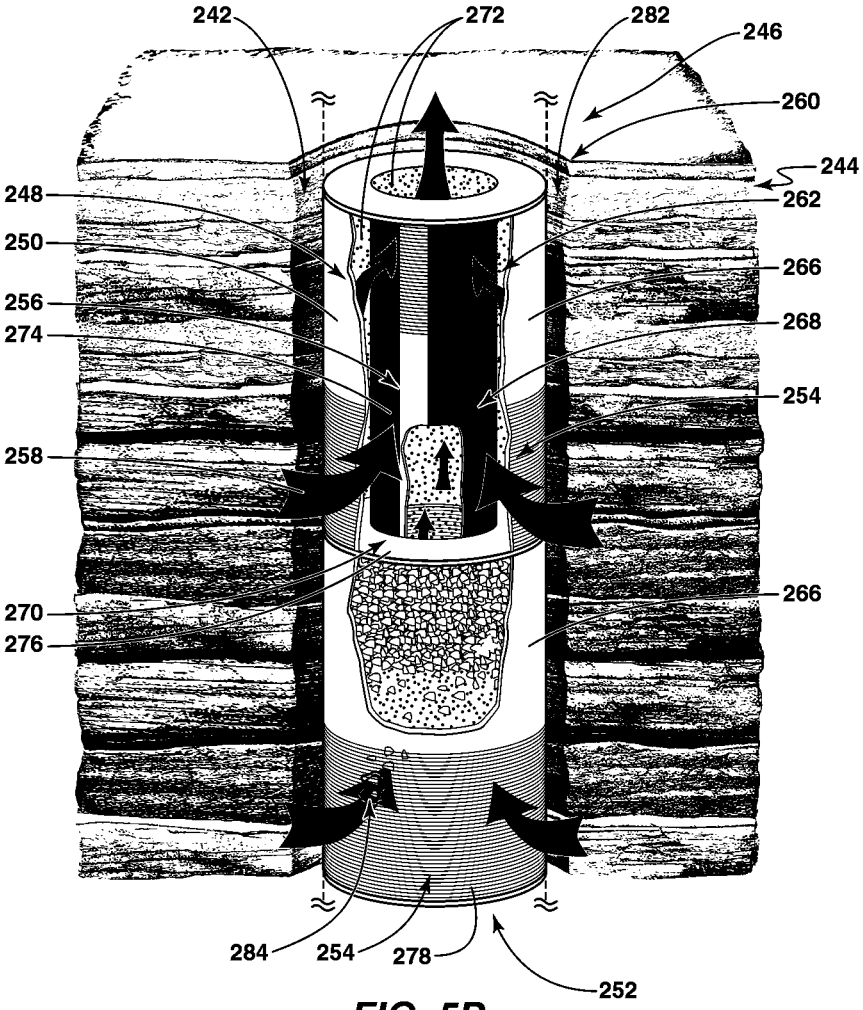

FIGS. 5A and 5B illustrate a flow control system 246 in a coaxial configuration 260, which configuration is also shown in FIG. 4. The coaxial configuration 260 is one example of the various implementations of flow control systems 246 within the scope of the present disclosure. FIG. 5A illustrates the coaxial configuration 260 in a fully open state while FIG. 5B illustrates the coaxial configuration having a flow control chamber 262 blocked by sand 264 or other particulates (hereinafter referred to generically as sand) from the formation 244. As seen in FIG. 5A, the flow control system 246 in a coaxial configuration 260 includes a tubular 248, which includes an outer member 250 that defines a flow conduit 252 within the outer member. Tubulars 248 may include nothing more than the outer member 250 or may comprise the outer member 250 together with various other apparatus, such as apparatus common in downhole production strings. In implementations where the tubular 248 includes additional apparatus, it should be understood that the descriptor "outer" in outer member 250 is relative to the flow conduit 252 defined by the outer member 250 rather than relative to the tubular 248. Tubular 248 and outer member 250 are illustrated in FIG. 5A as cylindrical members according to convention in the industry; however, other shapes and configurations may be used as well, such as ellipsoid or polygonal. The shape of the tubular 248 may impact the shape of the flow conduit 252 and/or the configuration of the flow control apparatus 256 disposed within the flow conduit 252. Additionally or alternatively, the configuration of the outer member 250 may have a greater impact on the configuration of the flow conduit 252 and/or flow control apparatus. For example, the outer member 250 may be adapted to provide permeable portions 254 and impermeable portions 266 in different locations along its length and/or periphery, which may affect the flow profile and, therefore, the configuration of the flow control apparatus 256. Accordingly, while FIGS. 5A and 5B illustrate an exemplary coaxial configuration 260, other coaxial configurations are within the scope of the present disclosure. Similarly, the remaining configurations or implementations described and illustrated herein are merely representative and variations and shapes and dimensions of the various parts are within the scope of the present invention.

Flow control systems 246 of the present disclosure include the outer tubular 250, as described above, and a flow control apparatus 256, which is disposed within the flow conduit 252. The flow control apparatus 256 comprises at least one conduit-defining structural member 268 and at least one chamber-defining structural member 270. The at least one conduit-defining structural member 268 may be in any configuration adapted to divide the flow conduit 252 into at least two flow control conduits 272. As illustrated in FIG. 5A, the conduit-defining structural member 268 includes a tubular member 274 disposed within the outer member 250 of the tubular 248. In FIG. 5A, the tubular member 274 and the outer member 250 are concentric, leading to the nomenclature of the coaxial configuration; however, it should be understood that the tubular member 274 may be disposed in any position within the flow conduit 252, including offset from the axis of the tubular 248 and/or adjacent to the outer member 250. The at least one conduit-defining structural member 268 used to divide the flow conduit 252 into at least two flow control conduits 272 may comprise a single physical member or may comprise multiple members, such as tubular members, walls, baffles, etc.

The flow control apparatus 256 also includes at least one chamber-defining structural member 270, as indicated above and representatively illustrated in FIG. 5A. In FIG. 5A, the chamber-defining structural member 270 is provided by a disk 276 spanning the annulus between the tubular member 274 and the outer member 250. Accordingly, the flow conduit 252 defined by the outer member 250 is divided into at least two flow control conduits 272 and at least two flow control chambers 262. Similar to the conduit-defining structural member 268, the chamber-defining structural member 270 may be provided in any suitable configuration, which may be influenced by the configuration of the outer member 250 and/or the configuration of the conduit-defining structural members 268. Similarly, the number of and the spacing between the chamber-defining structural members 270 may vary in implementations within the scope of the present disclosure. In the coaxial configuration 260 of FIG. 5A, the chamber-defining structural members 270 may be positioned within flow conduit 252 at even intervals and/or may be positioned in the flow conduit based at least in part on the measured or expected properties of the formation 244 in the region outside of the tubular 248.

A consideration of both FIGS. 5A and 5B will illustrate the functionality of the flow control systems 246 described herein. The functionality is first described in general terms and then more specifically with reference to the specific elements shown in FIGS. 5A and 5B. As described above, the flow control systems 246 of FIGS. 5A and 5B are identical but in two different states of operation. Flow control systems 246 of the present invention provide at least two flow control conduits 272 from a single flow conduit 252. Additionally, at least one of the flow control conduits 272 is divided into at least one flow control chamber 262. The at least one flow control chamber 262 includes at least one inlet 278 and at least one selective outlet 280. The at least one inlet 278 allows fluid from outside the tubular 248, such as from the well annulus 282 between the formation 244 and the tubular 248, through the outer member 250 and into the flow conduit 252, or, more specifically, into the flow control chamber 262. The inlet 278 is adapted to provide at least one barrier to flow impairment, such as by screening sand 264 from the flow. Accordingly, permeable portions 254 may provide the inlet 278 that also provides the barrier to flow impairment (e.g., sand control). The inlet 278 may provide the flow impairment barrier through any suitable configuration, such as using conventional sand control mechanisms of wire-wrapped screens, perforated tubing, pre-packed screens, slotted liners, mesh screens, sintered metal screens, etc.

Once the produced fluid has entered the flow control chamber 262, the fluid flows toward the outlet 280, which is illustrated in FIG. 5A as being offset from the inlet 278. The outlet 280 is also configured as a flow impairment barrier to provide redundancy in the efforts to counteract the various downhole conditions that can impair fluid flow. For example, and as illustrated in FIG. 5A, the outlet 280 from the flow control chamber 262 may be configured as a permeable segment adapted to retain sand 264 or other particles larger than a predetermined size. The configuration of the outlet may vary depending on the mechanism of flow impairment being counteracted. Additionally or alternatively, multiple outlets may be provided from a flow control chamber 262, as will be seen in connection with other Figures herein. The coaxial configuration 260 could be adapted to include two outlets by providing perforations, mesh, or other form of permeability in the chamber-defining structural member 270. In some implementations of the present invention, the configuration of the outlet and the inlet may be coordinated to provide redundancy against the same flow impairment mechanism(s). Additionally or alternatively, the inlet and/or the outlet may be configured to address additional and/or different mechanisms.

FIG. 5B illustrates the redundancy of the present flow control systems 246. In FIG. 5B, the inlet 278 to the flow control chamber 262 has been mechanically damaged to allow sand 264 into the flow control chamber 262, as illustrated by the hole 284 in the permeable portion 254. While sand passing through the sand control devices of conventional production tubing is a significant flow impairment, FIG. 5B illustrates that the redundant controls of the present inventions provides the outlet 280 from the chamber 262 with suitable flow control equipment to restrict the flow of particulates larger than a predetermined size from the flow exiting the flow control chamber. Accordingly, the sand 264 accumulates in the chamber until the outlet 280 is effectively blocked by the sand and the flow through the chamber is at least substantially blocked. In the implementation of FIGS. 5A and 5B, the flow from the outlet passes into another flow control conduit that is not divided into chambers and the fluids travel to the surface. In other implementations, the flow through the outlet 280 from one flow control chamber 262 may pass into another flow control chamber 262 having one or more outlets adapted to provide a barrier against a flow impairment mechanism. For example, to counteract the risks of sand production through the produced fluids and/or the risks of sand undesirably blocking flow paths. When the fluid flow passes from one flow control chamber to another flow control chamber, the chambers may be arranged in series to provide staged control and/or to address multiple flow impairment mechanisms. For example, a first flow control chamber may be adapted to control larger sand particles while a second flow control chamber may be adapted to control smaller sand particles, etc.

Advantageously, the flow control systems 246 of the present invention allow production to continue from an interval or zone in which one form of flow impairment has occurred. FIG. 5B illustrates this by showing that the unblocked flow control chamber 262 continues to produce fluids even after the outer screen (inlet 278) of the blocked flow control chamber 262 has failed and allowed sand to enter the flow conduit 252. Moreover, while flow through the lower flow control chamber is blocked, or at least substantially restricted, flow from the formation 244 may proceed through the well annulus 282 to enter the tubular 248 through the inlet 278 associated with the upper, unblocked flow control chamber. The flow path through the well annulus 282 provides yet another form of redundancy provided by the present flow control systems. Specifically, in the event that the lower flow control chamber is blocked by scale accumulation on the inlet thereto or other blockages on the outer member and inlet, the flow from the formation may continue through the well annulus 282 to enter adjacent flow control chambers.

The flow control systems 246 of the present disclosure, such as those illustrated in FIGS. 5A and 5B, may be adapted to offset the flow control chamber outlet 280 from the flow control chamber inlet 278, such as in the manner shown in FIGS. 5A and 5B. One of the flow impairment mechanisms that completion equipment attempts to prevent or address is the inflow of sand 264 while allowing fluids to flow into the flow conduit. Conventional methods utilize a screen or other permeable medium to restrict the flow of particulates while allowing fluids to pass. However, the permeability inherently reduces the structural integrity of the permeable portions. As solids-laden fluids impact the permeable segments it is common for these segments to fail and have a hole open in the permeable portion, such as illustrated by the hole 284 in FIG. 5B. Such holes defeat the sand-control objectives of the permeable segments and sand is allowed to flow into the production equipment. The risk of mechanical failure of the permeable segments increases in cased and/or fractured wells where produced fluids enter the well annulus 282 at discrete, focused sources.

The offset relationship between the flow control chamber inlet 278 and the flow control chamber outlet 280, which may be incorporated into one or more of the implementations herein, may provide an additional barrier against flow impairment due to mechanical failure of the completions equipment. Referring to FIG. 5 as an exemplary implementation, flow entering the flow control chamber 262 passes through the inlet 278 in a first direction; flows through the flow control chamber in a second direction; and exits through the outlet 280 by flowing in yet a third direction. The flow control apparatus 256 includes impermeable portions 266 adapted to provide a strengthened structural member in the vicinity of the inlet 278 to the flow control chamber 262. Accordingly, while the inlet 278 may cause fluids to be more concentrated in a particular flow direction, the flow control apparatus 256 is adapted to redirect that energy into a second flow direction, dissipating the energy carried by the entrained particles and encouraging the particles to drop out of the flow. This initial turn may be sufficient to sufficiently reduce the mechanical failure risk imposed by entrained particles impacting permeable segments. However, some implementations, such as illustrated in FIGS. 5A and 5B impose yet another flow direction change before passing through the outlet 280. The tortuous path followed by the particles attempting to flow through the production tubular 248 with the produced fluids reduces the energy of the particles and facilitates the task of the permeable portion providing the outlet 280 from the flow control chamber. The tortuous path may be induced in a variety of manners, some of which are illustrated and described in the present disclosure, and all of which are within the scope of the present invention.

Turning now to FIGS. 6A-6F, further implementations and features of flow control systems within the scope of the present invention will be described. The illustrations of FIGS. 6A-6F are highly schematic and intended to represent combinations of permeable surfaces and impermeable surfaces that may be used to form flow control conduits and flow control chambers within the scope of the present invention. While the permeable portions are represented by dashed lines are visually similar to conventional wire-wrapped screens, which may be used in the present invention, the permeable portions illustrated here are more broadly and schematically representing any of the variety of manners through which fluids may be allowed to pass through the outer member into the flow control chamber. For the sake of clarity in describing the various schematics of FIGS. 6A-6F, reference numbers will be used in connection with FIGS. 6A-6F that are different from those reference numbers used to refer to similar or identical elements or features in FIGS. 4 and 5. Similarly, the remaining Figures herein may use different reference numerals to aid in the clarity of the description of those Figures. The terms and nomenclature used to refer to common elements and features are consistent across the Figures and may be referred to in considering the similarities between the various implementations disclosed herein.

Figure 6A:
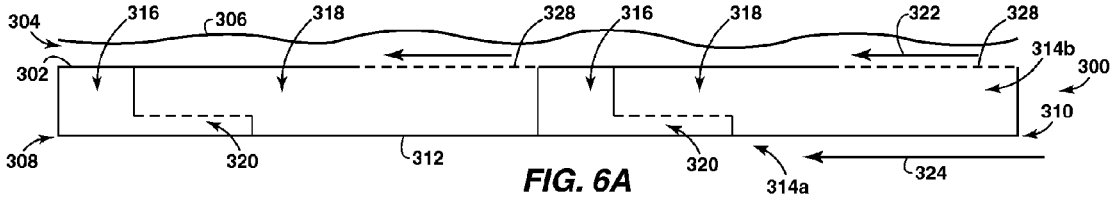
FIGS. 6A-6C are schematic side views presenting operational flow diagrams of some implementations of the present technology, with each figure representing different operational conditions.
Figure 6B:
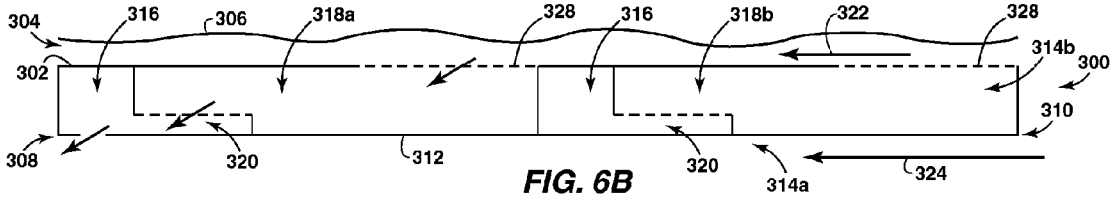
Figure 6C:
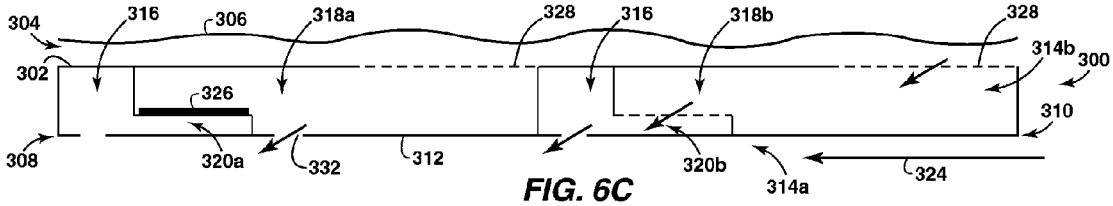

Beginning with FIGS. 6A-6C, three different operational configurations of a flow control system 300 are schematically illustrated. The flow control system 300 of FIGS. 6A-6C is illustrated as including an outer member 302 forming a well annulus 304 between the formation 306 and the outer member 302. However, for purposes of discussion and simplicity in illustration, only half of a side cross-sectional view is illustrated. As discussed previously, the outer member 302 also defines a flow conduit 308 within the outer member 302. Additionally, the flow control system 300 further includes flow control apparatus 310, which includes conduit-defining structural members 312 adapted to divide the flow conduit 308 into at least two flow control conduits 314 and chamber-defining structural members 316 adapted to divide at least one of the flow control conduits 314 into at least two flow control chambers 318. As one exemplary implementation that may be represented by the schematic of FIGS. 6A-6C, the coaxial configuration of FIGS. 5A and 5B would have a side cross-sectional view comparable to that of FIGS. 6A-6C.

FIGS. 6A-6C illustrate a flow control system 300 having outlets 320 from the flow control chambers 318 that are adapted to be selectively opened. As seen in FIG. 6A comparing FIGS. 6A-6C, the outlets 320 are both closed in FIG. 6A, preventing fluid flow through the flow control chambers 318. Accordingly, FIG. 6A illustrates a first operating configuration for flow control systems within the scope of the present disclosure in which the flow control system effectively acts as a blank pipe section. As illustrated by flow arrow 322, fluid in the well annulus 304 effectively stays in the well annulus as it passes the flow control system 300. Similarly, as illustrated by flow arrow 324, fluid within the flow control conduit 314*a* (which may have entered the flow control conduit from a portion of the well closer to the toe) stays within the flow control conduit 314*a*.

FIG. 6B illustrates the flow patterns when one of the outlets 320 is opened. As illustrated in FIGS. 6A-6C, the chamber-defining structural members 316 are more than a simple disk as illustrated in FIG. 5 and include both permeable segments and impermeable segments, which together are adapted to provide the selectively opening outlet 320 introduced above. The outlet 320 may be selectively opened through any of a variety of techniques, including chemical means (dissolution or other modifications of portions of the impermeable segment incorporating stimulus-responsive materials), mechanical means (sliding sleeves or other elements that are moved via hydraulic, electric, or other signals and controls), or other means (such as perforations or other available downhole tools). It should be understood that the physical implementation of a selectively opening outlet 320 may be as schematically illustrated here or in any other suitable method, such as a wire-wrapped screen having spaces filled by a material that can be dissolved or reduced in size to allow flow between the wrapped wires.

As illustrated, once the outlet 320 is opened fluid from the well annulus 304 passes into the flow control chamber 318*a*, through the outlet 320, and into the flow control conduit 314*a* for communication further up the well toward the surface. FIG. 6B illustrates that a selectively opening outlet 320 allows operator control over which flow control chambers 318 are operative at any given time, which may be used to control production rates or to control the type of completion applied (such as restricting smaller or larger particles). In some implementations, the selectively opening outlets 320 allow an operator to stage the production from a particular production zone. For example, as illustrated in FIG. 6B, fluids are produced through flow control chamber 318*a* and associated outlet while flow through flow control chamber 318*b* is blocked by the closed outlet. Subsequently, and as illustrated in FIG. 6C, the flow through flow control chamber 318*a* is blocked by the accumulation of sand 326 by the outlet 320*a*, which is adapted to retain particles larger than a predetermined size. When the production through flow control chamber 318*a* is substantially blocked by the accumulated sand 326, flow control chamber 318*b* and outlet 320*b* may be opened to allow continued production from the production zone while continuing to protect the production operation from flow impairment, such as sand inflow in this example. By staging the production in a production zone, the flow rate from that zone can be maintained for a much longer period of time without requiring a full workover. In some implementations, the outlet 320*b* may be adapted to apply a different degree of sand control compared to the outlet 320*a*. For example, the sand control features of outlet 320*b* may be allow larger particles to pass through to prevent accumulation of sand 326 at the outlet blocking flow through outlet 320*b*, which may allow the production to continue with a controlled amount of sands or fines production. Additionally or alternatively, the spacing between the inlets 328 to the respective flow control chambers may be sufficiently far to effectively limit or prevent sand from one formation zone (e.g., the zone adjacent to flow control chamber 318*a*) passing to the inlet of an adjacent flow control chamber through the well annulus 304. Accordingly, the configuration of the outlets 320*a* and 320*b* in adjacent flow control chambers may be different to retain the sand that is anticipated from the different formation zones. The configuration of outlets to retain particles larger than a predetermined size may be done on a chamber-by-chamber basis or may be done for the entire well. In any event, the predetermined size that is retained by a given outlet may be influenced by the formation, by the well, by the completion, by the manner in which the well is to be used, by the manner in which the flow control system is designed, and a variety of other factors.

FIG. 6C further illustrates that one or more of the chambers may be provided with a bare outlet 332 without sand control features, such as the outlet 332 illustrated in flow control chamber 318*a*. Such an outlet may be provided in a variety of circumstances where the economics or circumstances of the well no longer necessitate or suggest the desirability of the present, redundant flow control systems. For example, the redundant controls of the present flow control systems may be implemented during a period of time to maximize the life of the completion and productivity of the well interval while minimizing the sand production. However, there may be a time in the life of the well that some amount of sand production is acceptable as compared to a complete workover. For example, if all of the flow control systems in a completion have become blocked and the next step is to withdraw the production tubing for a workover, it may be preferred to open a bare outlet 332 in one or more of the flow control chambers to continue the production for a time with anticipated sand or fines production.

While FIGS. 6A-6C illustrate flow profiles in a flow control system 300 having staged utilization of the different flow control chambers 318, the flow profile through an inlet 328, through the flow control chamber 318, and through an outlet 320 is representative of the flow profiles of the implementations described in the present invention. Similarly, the schematic representation of the locations and orientations of the flow control chambers, the flow control conduits, the outer member, the conduit-defining structural members, the chamber-defining structural members, the inlets, the outlets, etc. are all representative only and may be embodied or implemented in any suitable configuration, including those described in greater detail herein. As described above, any one or more of these components may be referred to differently in an injection context rather than the production context described above. For example, outlet 320 may be considered an inlet to the flow control chamber and inlet 328 may be considered an outlet from the flow control chamber.

Figure 6D:
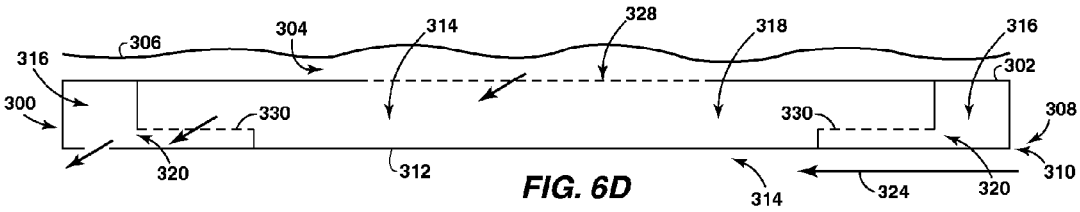
FIGS. 6D-6F are schematic side views presenting operational flow diagrams of some implementations of the present technology, with each figure representing different operational conditions.
Figure 6E:
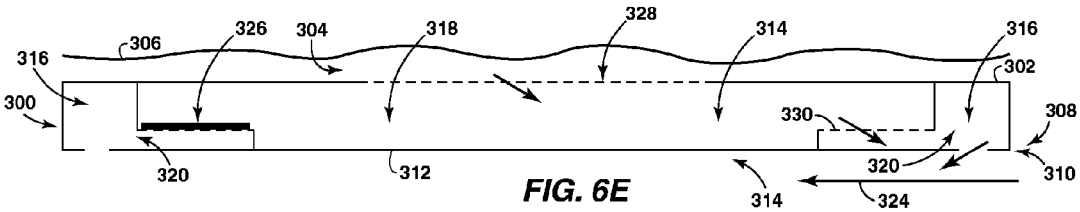
Figure 6F:
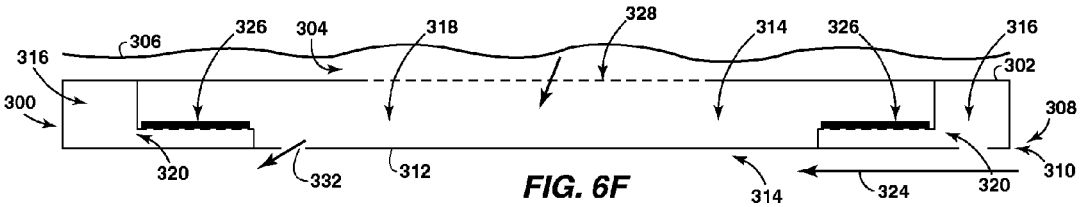

FIGS. 6D-6F provide further schematic illustrations of flow control systems 300 within the scope of the present invention. The flow control system 300 of FIG. 6D-6F includes many of the same features described above but arranged in a different implementation. Flow control system 300 includes an outer member 302 adapted to provide an inlet 328 therethrough and to define a flow conduit 308 therewithin. The flow control system 300 is disposed in a well such that the outer member 302 defines a well annulus 304 between the formation 306 and the outer member. Similar to the implementation described above, the flow control system 300 of FIGS. 6D-6F includes a flow control apparatus 310 adapted to be disposed within the outer member 302. The flow control apparatus 310 includes at least one conduit-defining structural member 312 defining at least two flow control conduits 314 within the flow conduit 308. Additionally, the flow control apparatus 310 includes at least one chamber-defining structural member 316 configured to divide at least one flow control conduit 314 into at least two flow control chambers 318. Additionally, the flow control apparatus 310 is configured to provide at least one outlet 320 from the flow control chamber 318.

As can be seen in FIGS. 6D-6F, the flow control systems 300 within the scope of the present inventions may include two or more outlets 320 per flow control chamber 318. Following the progression of operations from FIG. 6D to FIG. 6F, it can be seen that a first outlet 320 is opened in FIG. 6D to allow flow through the flow control chamber 318. The outlet 320 is provided with a permeable portion 330 or other features to counteract at least one flow impairment mechanism. For example, the outlet 320 may be provided with a screen or mesh to retain particles larger than a predetermined size. Additionally or alternatively, the outlet 320 may be adapted to counteract mechanical failure of the screen or mesh by being fluidically offset from the inlet 328, as discussed above. As illustrated in FIG. 6D, one outlet 320 is open while the other is closed. In some implementations, two or more outlets may be open at the same time depending on the flow parameters desired for the particular well, zone, and/or chamber of the production equipment.

As illustrated in FIG. 6E, the second outlet 320 is opened once the first outlet 320 is effectively and/or substantially closed by the accumulation of sand or other particles. 326. The selective opening of the outlets 320 allows the operator to control the flow through the individual flow control chambers. In some implementations, the selective opening of the outlets is controlled from the surface through any suitable means. The control from the surface for opening an outlet is acceptable because delays in opening an outlet do not introduce increased risks of flow impairment or damage to the production equipment. Additionally or alternatively, control of the various selectively opening outlets 320 may be effected passively, or without direct operator or surface intervention. For example, the second opened outlet 320 in FIG. 6E may be configured to open when pressure from the flow control chamber 318 exceeds a predetermined set point selected to indicate that the first outlet is sufficiently blocked by particles. Additionally or alternatively, the positioning of the second outlet within the chamber may be sufficient to render it effectively closed until the first outlet becomes sufficiently blocked. For example, in FIG. 6E, the flow in the well annulus 304 is illustrated as moving from right to left. The flow will tend to enter the inlet 328 and continue in the right to left manner towards the first opening 320 (illustrated as open in FIG. 6D and closed in FIG. 6E). Natural flow forces will not direct substantial flows toward the second outlet 320 until there is sufficient back pressure against the first outlet.

As described above, in some implementations the staged or selectively opening outlets may be implemented for the purpose of maintaining production rates over an extended period of time from the same segment of the formation. Additionally or alternatively, staged or selectively opening outlets may be implemented for the purpose of counteracting different flow impairment mechanisms and/or different degrees of risks of flow impairment. As one example of such an implementation, a first outlet may be configured to retain a first predetermined size of particles while the second outlet may be configured to retain a second, larger predetermined size of particles. Accordingly, the well, or region of the well, may be operated for a first time during which all particles larger than the smaller, first predetermined size are retained and accumulated against the outlet. When the second outlet is opened, flow may resume or continue from that chamber and will allow particles smaller than the second predetermined size to pass through the outlet. Such an implementation may be suitable when differing degrees of flow quality and/or risks are tolerated at different stages in the life of a well. FIG. 6F illustrates a still further configuration of the flow control system 300 wherein both of the outlets 320 including permeable portions 330 are blocked. In such a condition flow through the chamber 318 would be blocked. However, in some implementations, it may be acceptable to open a bare outlet 332 that is not adapted to retain particles or otherwise prevent or counteract a flow impairment mechanism. Flow may then resume through the flow control chamber 318. Such an implementation may be used when the sand production risk has been minimized or when the risks of sand production are acceptable in light of the other conditions associated with the continued operations of the well, such as the workover costs, etc.

Figure 7A:
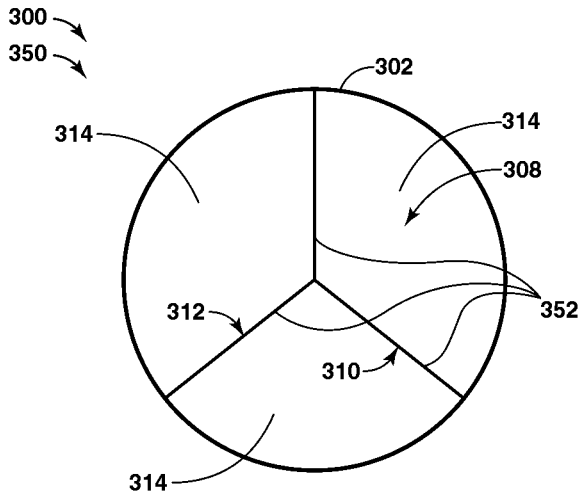
FIG. 7A is a cross-sectional end view of a trifurcated configuration of the present technology.
Figure 7B:
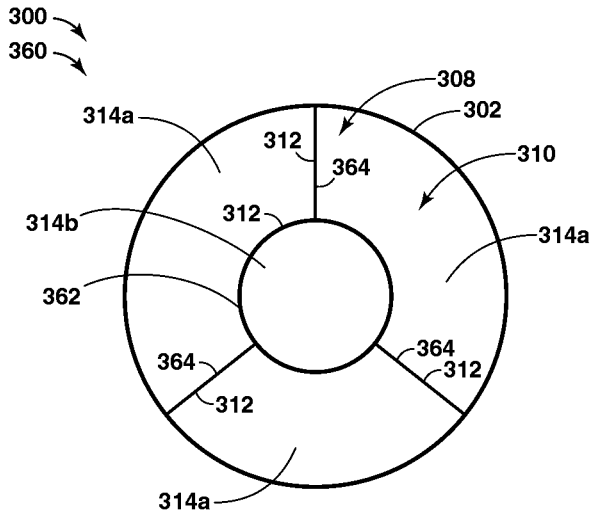
FIG. 7B is a cross-sectional end view of a coaxial-furcated configuration of the present technology.

FIGS. 7A-7C schematically illustrate still additional implementations of flow control systems within the scope of the present invention. As described above, FIGS. 5A and 5B illustrated a coaxial configuration of the flow control systems and FIGS. 6A-6F illustrated schematically flow diagrams characteristic of various configurations and implementations to be described herein. FIG. 7A illustrates an end view of a trifurcated flow control system 350. As with the other implementations described and claimed herein, the trifurcated flow control system 350 includes an outer member 302 defining an internal flow conduit 308. As illustrated in FIG. 7A, the flow conduit 308 is trifurcated by a flow control apparatus 310 including conduit-defining structural members 312 in the form of three partitions 352. The partitions 352 divide the flow conduit 308 into three flow control conduits 314, any one or more of which may be divided further by chamber-defining structural members (not shown). The trifurcated configuration 350 of FIG. 7A is representative of the various manners in which conduit-defining structural members may be disposed to divide the flow conduit 308 into two or more flow control conduits 314. The partitions 352 may be configured as solid panels and/or may be configured to provide outlets (not shown in FIG. 7A), such as those described elsewhere herein, to allow flow between adjacent flow control conduits 314 and/or chambers. Additional, more detailed examples of trifurcated and/or multi-furcated flow control systems 350 are provided below.

FIG. 7B provides a schematic end view of another implementation of a furcated flow control system. FIG. 7B schematically illustrates a flow control system 300 in a coaxial-furcated configuration 360. The coaxial-furcated configuration 360 is yet another example of the various manners in which a flow control apparatus 310 may be implemented within an outer member 302 of a flow control system 300. As illustrated, the coaxial-furcated configuration 360 includes a plurality of conduit-defining structural members 312, including an inner tubular 362 and three partitions 364 extending between the outer member 302 and the inner tubular 362, partitioning or dividing the annulus therebetween into multiple flow control conduits 314. Additionally, the inner tubular 362 provides yet another flow control conduit 314. Any one or more of these flow control conduits 314 may be divided into flow control chambers (not shown) through the use of chamber-defining structural members (not shown), which may be adapted to conform or substantially conform to the dimensions of the flow control conduits 314. In exemplary implementations, each of the exterior flow control conduits 314*a* may be formed into flow control chambers while the inner flow control conduit 314*b* may be left open for unimpeded flow of fluids through the tubing string. Similar to the schematic illustration of FIG. 7A, the conduit-defining structural members 312 of FIG. 7B, including the inner tubular 362 and the partitions 364, may be configured as solid panels and/or may be configured to provide outlets (not shown in FIG. 7B), such as those outlets described elsewhere herein, to allow flow between adjacent flow control conduits and/or chambers.

Figure 8B:
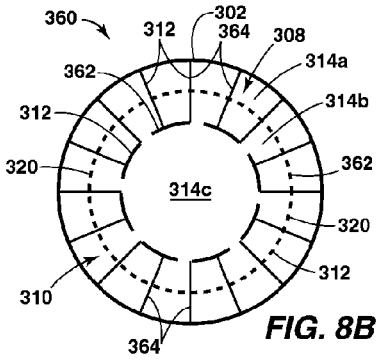
FIGS. 8B-8D are cross-sectional views of the implementation illustrated in FIG. 8A at the indicated locations.
Figure 8C:
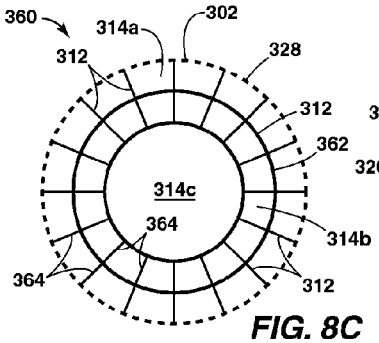
Figure 8D:
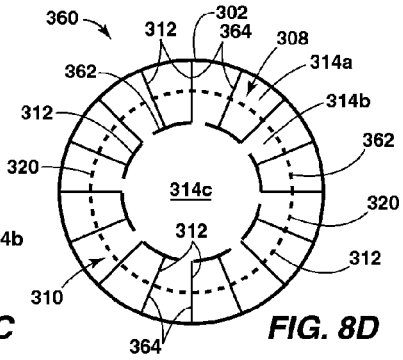
Figure 8A:
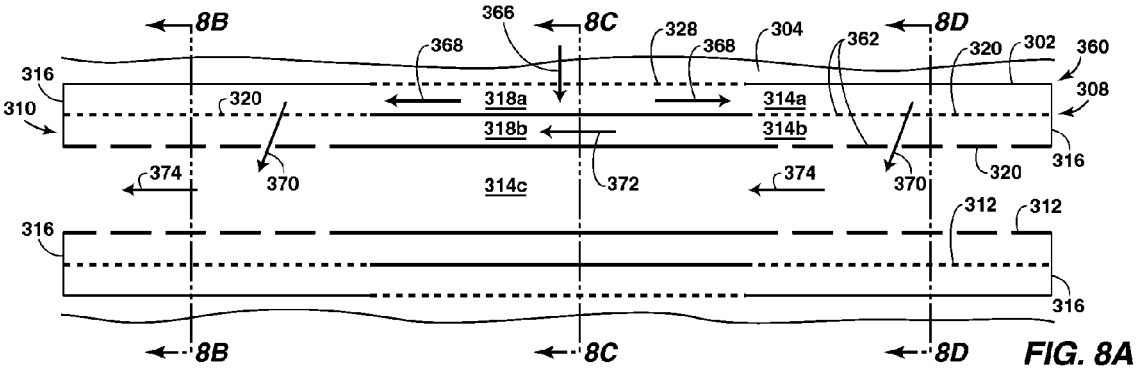
FIG. 8A is a cross-sectional side view of a coaxial-furcated configuration of the present technology.
Figure 9B:
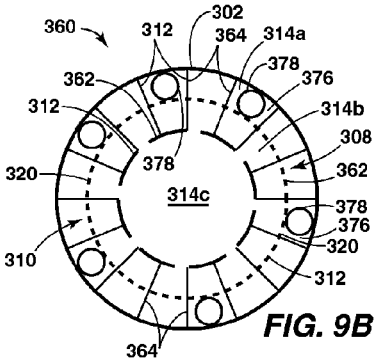
FIGS. 9B-9D are cross-sectional views of the implementation illustrated in FIG. 9A at the indicated locations.
Figure 9C:
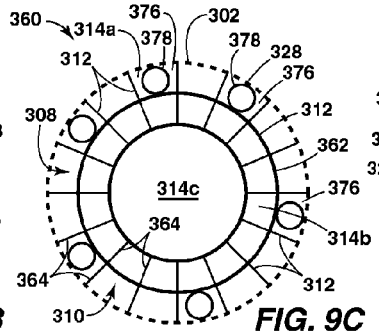
Figure 9D:
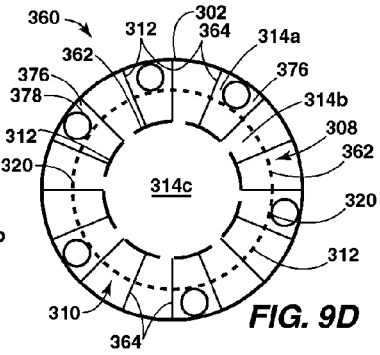
Figure 9A:
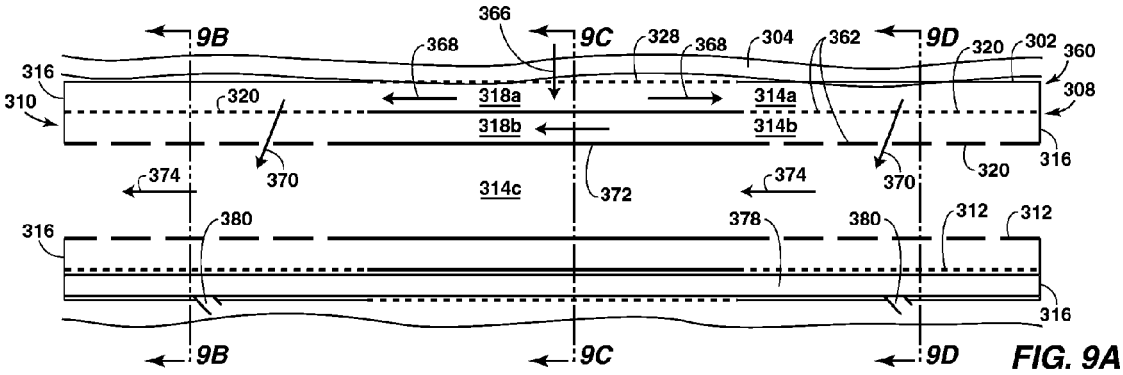
FIG. 9A is a cross-sectional side view of a coaxial-furcated configuration of the present technology including injection conduits.

FIGS. 8A-8D provide yet another exemplary implementation of a coaxial-furcated configuration 360. The implementation illustrated in FIG. 8A shows that the flow control apparatus 310 may include multiple conduit-defining structural members 312 disposed and configured in any suitable manner to create at least two flow control conduits 314 from the flow conduit 308 defined by the outer member 302. As illustrated in FIG. 8A, the coaxial-furcated configuration 360 effectively provides a plurality of concentric flow control conduits 314*a*, 314*b*, 314*c* through the use of multiple inner tubulars 362. The outer member includes at least one inlet 328 to the flow conduit 308, and particularly to the flow control conduit 314*a*.

With continuing reference to FIG. 8A, once the fluid has entered the flow conduit 308, it is able to flow within the flow control chamber 318*a* defined by the conduit-defining structural members 312, the chamber-defining structural members 316 and the outer member 302. Fluid in the outer flow control conduit 314*a* or outer flow control chamber 318*a* may then exit the flow control chamber through outlets 320 provided in the conduit-defining structural member 312, which may be any suitable form of outlet providing fluid communication between the outer flow control conduit 314*a* and the intermediate flow control conduit 314*b*. The configuration of the outlet 320 may vary depending on the flow impairment mechanism for which the flow control system 300 is adapted. Exemplary outlets may provide a permeable portion, such as described above, adapted to retain particulate material larger than a predetermined size.

As illustrated by the configuration of the outer member 302, the inlet 328 providing fluid communication between the well annulus 304 and the flow conduit 308 may be adapted to counteract flow impairment as described herein. For example, the inlet 328 may be a wire-wrapped screen, a mesh, or configuration adapted for sand control. Exemplary configurations of the outer member 302 may include an inlet 328 provided by a wire-wrapped screen having gaps between adjacent wires that is sufficient to retain formation sand produced into the wellbore larger than a predetermined size. Other portions of the outer member 302 may be provided in any suitable manner such as blank pipe, impermeable material wrapped on the outside of a permeable media, or a wire-wrapped screen without a gap between adjacent wires. Manufacturing of a wire-wrapped screen is well known in the art and involves wrapping the wire at a preset pitch level to achieve a certain gap between two adjacent wires. Some implementations of suitable outer members may be manufactured by varying the pitch used to manufacture conventional wire-wrapped screens. For example, one portion of an outer member may be prepared by wrapping a wire-wrapped screen at a desired pitch that would retain formation sand larger than a predetermined size and wrapping the next portion at near zero or zero pitch (no gap) to create an essentially impermeable media section. Other portions of the outer member 302 could be wrapped at varying pitches to create varying levels of permeable sections or impermeable sections.

The inner tubulars 362 may be provided in a manner similar to the manner described for the outer member 302 using wire-wrapped screen techniques. Using the variety of wire configurations available and the variety of pitches, the outlets 320 provided by the permeable portions may be provided in a multitude of configurations suitable for retaining particles of any predetermined size. Additionally or alternatively, the permeable portions on the flow control apparatus 310 (as compared to the permeable inlet on the outer member 302) may be provided in other suitable manners to provide the desired functionality, such as the selectively opening outlets 320 described in connection with FIG. 6. In implementations where the outlet 320 from the flow control chamber 318 is fluidically offset from the inlet 328 to the flow control chamber, greater flexibility in the configuration of the outlet may be available. As discussed above, the fluidically offset inlet 328 and outlets 320 provide an impermeable, and therefore stronger, conduit-defining structural member 312 in the region in the fluidic path from the well annulus 304 through the inlet 328 to resist mechanical damage to the chamber-defining structural member 312 due to the force of the incoming fluid and/or particles.

In the exemplary configuration shown in FIGS. 8A-8D, the flow conduit 308 is divided into two annular flow control conduits 314 by the inner tubulars 362 which are further divided into longitudinal flow control conduits by the partitions 364 extending within the annular flow conduits (as seen in FIGS. 8B-8D). Flow entering a flow control conduit 314 through an inlet 328 encounters the impermeable member of the conduit-defining structural member 312, as seen by flow arrow 366 in FIG. 8A. The flow is then diverted, together with the dissipation of energy carried by the fluids and particles in the flow, longitudinally within the longitudinal flow control conduits 314 created and defined by the flow control apparatus and conduit-defining structural member 312, as seen by flow arrows 368. The flow is then isolated longitudinally by the chamber-defining structural members 316. Outlets 320, which may be selectively opening outlets, provide fluid communication between the outer longitudinal flow control conduit 314*a* and the intermediate longitudinal flow control conduit 314*b*. As discussed above and similar to the inlet 328, the outlets 320 may be provided by a permeable portion or in another suitable configuration to retain particles larger than a predetermined size. The flow within the intermediate flow control conduit 314*b* may then pass through outlet 320 into the inner flow control conduit 314*c*, as seen by flow arrows 370, or may flow longitudinally along the intermediate flow control conduit 314*b*, as seen by flow arrows 372. For example, in the event that one of the outlets 320 from the intermediate flow control conduit 314*b* becomes blocked by particle accumulation, the fluids may flow longitudinally to the other outlet 320 to maintain production from the respective section of the production tube. Additionally or alternatively, the outlets from the intermediate flow control conduit 314*b* may be fluidically offset (not shown) from the outlets from the outer flow control conduit 314*c*. Once the fluids pass through the outlet 320 from the intermediate flow control conduit 314*b* to the inner flow control conduit 314*c*, the fluids are in fluid communication with the surface and are part of the production flow represented by flow arrows 374.

In some implementations, the outer flow control conduit 314*a* and associated outlet may be adapted to provide an initial filter to retain larger particles while allowing finer particles to pass through and the intermediate flow control conduit 314*b* and associated outlet may be adapted to provide a final filter to remove smaller particles. Additionally or alternatively, the outer and intermediate flow control conduits and associated outlets may be substantially similar and provide redundancy at the same level of filtration rather than differing degrees of filtration. In any event, should the inlet 328 fail and allow particles to enter the flow conduit 308, the outer flow control conduit 314*a* and associated outlet provide a first barrier to the infiltration of sand into the production stream 374. Additionally, in the event that the outlet 320 from the outer flow control conduit 314*a* is designed to allow some particles through or in the event of mechanical failure of the outlet, the intermediate flow control conduit 314*b* and associated outlet provide a second barrier to the infiltration of sand into the production stream. Coupled with the energy dissipation of the fluidically offset inlets and outlets, the flow control systems 300 of the present disclosure provide enhanced abilities to prevent flow impairment due to the multiple redundant flow paths formed within the outer member 302 and the flow conduit 308. In the event that each of the outlets from a given flow control chamber 318 is blocked or substantially blocked due to particle accumulation (or due to the possible configuration as selectively opening), production fluids from the adjacent formation may enter the well annulus 304 and proceed to an adjacent segment of the production tubing string that is not yet blocked. Accordingly, the redundant flow paths and redundant systems to allow production operations to continue while preventing sand infiltration and overcoming other forms of flow impairment.

FIGS. 8B, 8C, and 8D are cross-sectional views of FIG. 8A at the designated locations of FIG. 8A wherein like elements from FIG. 8A are given the same reference numbers. These figures illustrate the changes from permeable walls (dashed lines) to impermeable walls (solid lines) based on the location in the wellbore. Additionally, while not illustrated in FIGS. 8A-8D, any one of the conduit-defining structural members 312, such as the partitions 364, may be provided with permeable portions to provide an outlet from one longitudinal flow control conduit to an adjacent flow control conduit. Fluid communication between longitudinal flow control conduits illustrated in FIGS. 8A-8D may provide still further redundancies in the flow paths to permit fluid flow while countering the flow impairment mechanisms. The configuration and disposition of the outlets formed in the partitions 364 may incorporate the fluidic offset principles described above, such as by being disposed longitudinally offset from the inlet 328. Additionally or alternatively, outlets on partitions may be disposed in longitudinal alignment with the inlet 328 while still providing the fluidic offset advantages described above. As described above, the fluidic offset between inlets and outlets may be implemented to dissipate the energy in incoming flows against a solid, and therefore more resistant, conduit-defining structural member rather than an outlet. The offset causes the incoming flow to change directions upon entering the flow control conduit (e.g., from a radially directed flow through the inlet to a longitudinally directed flow in FIG. 8A). The longitudinally offset outlets illustrated in FIG. 8A force another flow direction change as the flow passes through the outlet (e.g., from longitudinal flow in the conduit to radial flow through the outlet). In implementations providing one or more outlets in the partitions 364, similar flow directional changes are created. For example, radial flow through the inlet is changed to circumferential flow due to the relationship between the solid inner tubular and the outlet in the partition.

FIGS. 9A-9D provide an example of the flow control system 300 further adapted for use in operations requiring flow in the reverse or injection direction, such as treatment operations and/or gravel packing operations. FIGS. 9A-9D are analogous in many respects to the coaxial-furcated configuration 360 of FIGS. 8A-8D and similar reference numerals refer to similar elements without their express recitation here in connection with FIGS. 9A-9D. As illustrated in FIGS. 9A-9D, one or more of the flow control conduits 314 may be configured as an injection conduit 376. The exemplary configuration illustrated includes a shunt tube 378 disposed within the injection conduit 376 and nozzles 380 extending from the shunt tube through the outer member 302. When a shunt tube 378 is used, the injection conduit 376 may have sufficient space remaining to allow the flow control conduit to be used for production purposes as well. Alternatively, the flow control conduit in which the shunt tube is disposed may be adapted for exclusive use as a conduit for the shunt tube. Additionally or alternatively, one or more of the flow control conduits 314 may be adapted for injection operations without the use of shunt tubes 378. For example, the use of solid, impermeable conduit-defining structural members and appropriate inlets and outlets may enable one flow control conduit to be used for injection operations while an adjacent flow control conduit is adapted for production operations. The incorporation of shunt tubes 378 and/or injection conduits 376 may allow the present flow control systems to be used in gravel packing operations, such as disclosed in U.S. Pat. Nos. 4,945,991, 5,082,052, and 5,113,935.

Figure 10A:
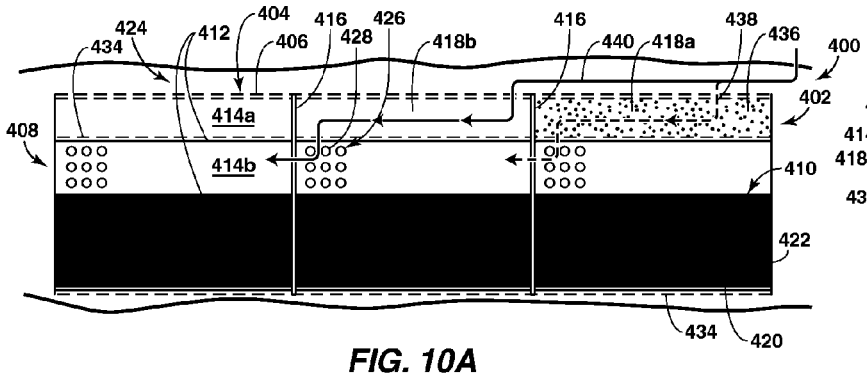
FIG. 10A is a partial cutaway side view of an eccentric configuration of the present technology.
Figure 10B:
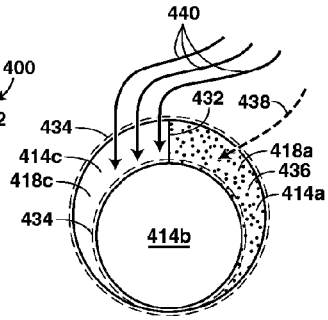
FIG. 10B is a cross-sectional view of the configuration illustrated in FIG. 10A.

FIGS. 10A and 10B provide a cut-away side view and a cross-sectional view, respectively, of yet another implementation of flow control systems 400 within the scope of the present invention. While the eccentric configuration 402 is illustrated and described separately from the implementations and configurations described above, the features and aspects of this implementation, as with the other implementations and configurations described herein, are interchangeable between configurations. For example, configurations of the outlets and inlets described above in connection with the coaxial implementation, the furcated implementation, and/or the coaxial-furcated implementation may be utilized in the eccentric configuration 402 without specific repetition of such features or configurations in connection with the eccentric configuration. Similar to the implementations described above, the eccentric configuration 402 incorporates flow path redundancy and redundant flow impairment countermeasures to enhance the longevity and functionality of the downhole equipment. The eccentric configuration 402 of FIGS. 10A and 10B is illustrated in the context of countering the sand infiltration flow impairment mechanism, but is also effective in countering the effects of scale build-up on inlets to the production equipment. Additionally, to the extent that increases in sand production are often associated with corresponding increases in water production, the present flow control systems may be effective in countering the water production flow impairment mechanism.

As illustrated in FIGS. 10A and 10B, the eccentric configuration 402 includes a tubular 404 having an outer member 406 that defines a flow conduit 408. Within the flow conduit 408 is disposed a flow control apparatus 410 having conduit-defining structural members 412 adapted to divide the flow conduit 408 into at least two flow control conduits 414 and having chamber-defining structural members 416 adapted to divide at least one of the flow control conduits 414 into at least two flow control chambers 418. The outer member 406 is also provided with an inlet 420 represented by the perforations 422. The perforations 422 or other inlet means providing fluid communication between the well annulus 424 and the flow control conduit 414 may be adapted to retain particles larger than a predetermined size or may be otherwise adapted to counter a flow impairment mechanism. The flow control apparatus 410 also includes an outlet 426 adapted to provide fluid communication between the outer flow control conduit 414*a* and the inner flow control conduit 414*b*. The outlet 426 is represented or illustrated by perforations 428 and may be provided in any suitable manner to counter one or more flow impairment mechanisms, such as described elsewhere herein. As illustrated in FIGS. 10A and 10B the outer member 406 and components of the flow control apparatus 410 may be provided by conventional pipes provided with perforations to provide the appropriate inlets and outlets. While the perforations themselves may be adapted to retain particles larger than a predetermined size (or provide some other countermeasure to flow impairment), the outer member 406 and/or the flow control apparatus 410 may include sandscreens 434, which may extend along the entire length of the member as illustrated or only over the perforated lengths.

With reference to FIG. 10B, it can be seen that the eccentric configuration 402 is provided with two types of conduit-defining structural members 412, including an inner tubular 430 disposed eccentrically within the outer member 406 and dividing the flow conduit 408 into an inner flow control conduit 414*b* and an outer flow control conduit, which is further divided by partition 432 into a first outer flow control conduit 414*a* and a second outer flow control conduit 414*c*. The degree of eccentricity and the relative sizes of the various flow control conduits are representative only and may be varied depending on the implementation.

FIGS. 10A and 10B illustrate the manners in which the redundant flow paths can extend the life of a completion despite efforts of the formation to impair the production operations, such as through sand production. Considering the implementation of FIG. 10A, flow control chamber 418*a* is illustrated as having a failed sandscreen at the inlet 420 thereto allowing sand 436 to enter the flow control chamber 418*a*. As sand accumulates in flow control chamber 418*a*, the resistance to flow increases and less fluid passes through the outlet 426 from the flow control chamber 418*a*. Accordingly, less fluid enters the flow control chamber 418*a*, as illustrated by the dashed flow lines 438. The chamber-defining structural member 416 and the outlet 426 blocked or substantially blocked by the infiltrated sand creates an effective isolated stage while allowing continued production of fluids from adjacent the isolated stage through the well annulus 424 and the flow control chamber 418*b*, following the detoured flow path represented by detour flow line 440.

The illustration of FIG. 10A illustrates two advantageous scenarios that may occur during operation of a well provided with a flow control system of the present invention. As described above, the infiltrated flow control chamber 418*a* becomes packed with sand 436. While the outlet 426 may become completely blocked by the accumulated sand, it is also possible that the outlet 426 functions as a conventional sandscreen and the infiltrated sand 436 functions as a natural sand pack within the isolated flow control chamber 418*a*. The possibility of a natural sand pack forming from the infiltrated sand may depend on the nature of the formation in which the flow control system 400 is disposed. Additionally, however, the configuration of the flow control chamber 418*a* and the outlet 426 therefrom may promote or discourage the formation of a natural sand pack from the infiltrated sand. In some implementations, the completion engineers and/or equipment manufacturers may adapt the flow control apparatus 410 to encourage the formation of a natural sand pack in the infiltrated flow control chambers. The natural sand pack in flow control chamber 418*a* may allow continue hydrocarbon production through the flow control chamber while retaining sand from entering the inner flow control conduit 414*b* and further protecting the outlet 420 from mechanical damage.

Additionally or alternatively, the redundant, detour flow path 440 provided by the flow control system 400 dissipates the energy of sand entrained in the flow entering the well annulus adjacent the infiltrated flow control chamber 418*a*. As illustrated in FIG. 10A, the sand entrained fluid enters the well annulus 424 and is forced to travel longitudinally through the annulus before encountering another inlet 420 through the outer member 406. As described above, the change in direction forced by the fluidic offsets dissipates energy that may be stored in entrained sand. FIG. 10A illustrates that the fluidic offset may be established in the well annulus as well as in the flow control conduits within the flow conduits of the present flow control systems.

FIG. 10B illustrates yet another manner in which the eccentric configuration 402 provides redundant flow paths and redundant protection from flow impairment. As illustrated in FIG. 10B, infiltrated sand 436 may enter only one of the outer flow control conduits, such as the first outer flow control conduit 414*a*. In such circumstances, the produced fluids may flow circumferentially around the outer member 406 to enter the second outer flow control conduit 414*c*, which not yet infiltrated in the illustration of FIG. 10B. Similar to the circumstances illustrated in FIG. 10A, the infiltrated flow control chamber 418*a* may provide a natural sand pack in some implementations allowing produced fluids to continue through the infiltrated flow control chamber 418*a*, albeit at lower rates. Additionally or alternatively, the circumstances of FIG. 10B illustrate that the detoured flow paths 440 may run circumferentially as well as or as an alternative to the longitudinal flow illustrated in FIG. 10A.

As described above in connection with the other configurations of the present invention, the various structural members of the flow control apparatus 410 may be adapted to provide permeable segments as appropriate to create the redundant flow paths and the redundant particle retention systems described herein. For example, partition 432 and/or chamber-defining structural members 416 may be provided with perforations, mesh, wire-wrap or other means to provide fluid communication between flow control conduits and/or flow control chambers.

Figure 11A:
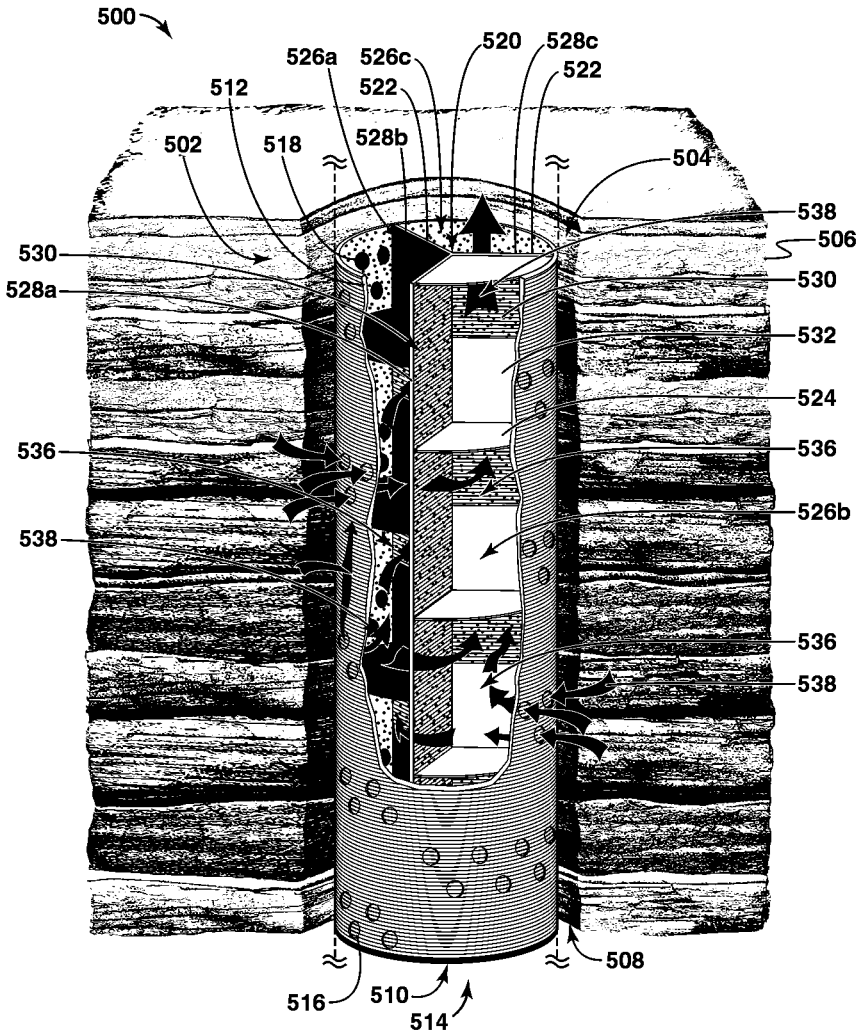
FIGS. 11A and 11B are partial cut-away views of a flow control system according to the present technology in a first operational condition and a second operational condition, respectively.
Figure 11B:
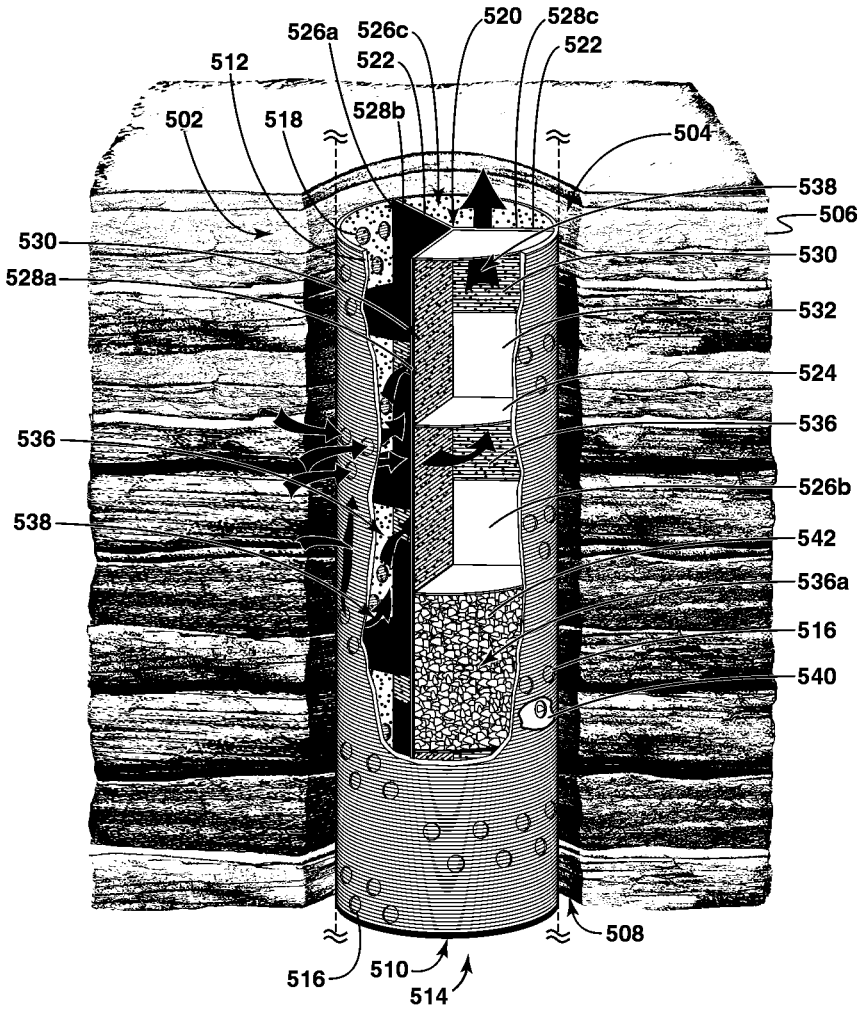

Turning now to FIGS. 11A and 11B, an enlarged view of the other flow control system from FIG. 4 is illustrated. Similar to the discussion related to FIGS. 5A and 5B, the operation of this flow control system configuration will now be described in greater detail. FIGS. 11A and 11B illustrate a partial cutaway view of a flow control system 500 in a stepped configuration 502. As with prior illustrations, the flow control system 500 is disposed within a well 504 in a formation 506, forming a well annulus 508 between the flow control system and the formation. While the flow control system 500, as well as other implementations described herein, is illustrated representatively as being in an open hole well, the systems and methods of the present invention are useful in cased hole wells as well.

The stepped configuration 502 of the flow control system 500 includes a tubular 510 that includes an outer member 512. As illustrated, the tubular 510 includes a perforated base pipe and a wire-wrapped screen. In this implementation, the perforated base pipe provides the outer member 512 that defines a flow conduit 514 and that provides an inlet 516 to the flow conduit allowing fluid communication between the flow conduit and the well annulus 508. The perforations 518 are one example of an inlet to the flow conduit 514. Similarly, the perforated basepipe is only one example of the variety of manners of providing an outer member having an inlet and defining a flow conduit. Other suitable means are known to those of skill in the art and are included within the scope of the present invention. It should be noted that the tubular associated with flow control conduit 526*c* is not provided with perforations or other means for providing an inlet to the flow conduit. Accordingly, the only way for fluid to enter the flow control conduit 526*c* (described further below) is by passing through a flow control chamber. Flow control conduits that only are in fluid communication with the formation or well annulus through a flow control chamber may be considered a production flow control conduit, which may be in communication with the surface.

With continuing reference to FIGS. 11A and 11B, the stepped configuration 502 of the flow control system 500 includes a flow control apparatus 520 disposed within the flow conduit 514. Similar to those implementations described elsewhere herein, the flow control apparatus 520 includes conduit-defining structural members 522 and chamber-defining structural members 524. The conduit-defining structural members 522 are adapted to divide the flow conduit 514 into at least two flow control conduits 526. In the illustrated implementation of a stepped configuration, the conduit-defining structural members 522 are provided by a plurality of partitions 528 arranged to trifurcate the flow conduit. Additionally or alternatively, additional conduit-defining structural members may be provided to further divide the flow conduit 514. The partitions 528 of the conduit-defining structural members 522 include both permeable sections 530 and impermeable sections 532. The permeable sections 530 are adapted to allow fluid communication between adjacent flow control conduits 526 while retaining particles larger than a predetermined size. Accordingly, the permeable sections 530 are one manner of providing an outlet 534 from the flow control chambers 536 defined by the chamber-defining structural members.

The impermeable sections 532 are adapted to prevent flow fluid therethrough. As illustrated in FIG. 11A, the impermeable sections 532 are disposed in operative association with the perforations 518. The impermeable sections of the flow control apparatus may be arranged or adapted to be in direct fluid communication with the inlet 516 so as to absorb and/or deflect the energy carried by the entering fluids and particles. Additionally or alternatively, the impermeable sections 532 may be disposed so as to cause the outlets 534 from the flow control chambers 536 to be fluidically offset from the inlets 516. While the illustrated implementation provides impermeable sections 532 on only one partition forming flow control conduit 526*b*, other implementations may provide alternative configurations including impermeable sections on both partitions and/or in different relationships.

The stepped configuration 502 of FIGS. 11A and 11B provide three flow control conduits 526*a*-526*c* with two flow control conduits divided into a plurality of flow control chambers 536. As illustrated, the flow control chambers 536 in each flow control conduit are stacked longitudinally in the flow conduit while the flow control chambers in adjacent flow control conduits 526 are offset from each other. Moreover, as illustrated in FIGS. 11A and 11B, the partition 528*a* includes permeable sections to allow fluid flow between flow control chambers in adjacent flow control conduits. Accordingly, in this implementation, the partition provides at least one outlet from the flow control chambers 536. Additionally, as illustrated in FIGS. 11A and 11B, the partitions 528*b* and 528*c* include permeable sections 530 adapted to allow flow from the flow control chambers 536 into the flow control conduit 526*c*, which is not divided into flow control chambers.

The stepped configuration 502 operates or functions in a manner similar to the configurations described elsewhere herein. For example, the flow control apparatus 520 divides the flow conduit into a plurality of flow control conduits and flow control chambers. The flow control conduits and flow control chambers provide redundant flow paths through the tubular and provide redundant countermeasures to resist flow impairment, particularly flow impairment due to sand production and/or particle accumulation or scaling. The flow arrows 538 of FIG. 11A illustrate the multiple redundancies built into the stepped configuration 502. Depending on the configuration of the impermeable sections and the permeable sections of the conduit-defining structural members, the incoming radial fluid flow may be redirected longitudinally and/or circumferentially before exiting the flow control chamber. The availability of multiple outlets and flow paths from each chamber may also allow each flow control chamber to become more fully packed with infiltrated sand.

The combination of FIGS. 11A and 11B illustrate what happens to the flow control system in the stepped configuration when the inlet to the flow conduit is impaired and begins to allow sand to enter the flow conduit. As illustrated in FIG. 11B, the inlet 516 to the flow control chamber 536*a* is impaired due to erosion or other mechanical wear and a hole 540 is opened in the wire-wrapped screen permitting the entry of sand 542 into the flow control chamber 536*a*. The sand 542 may begin to accumulate against any one of the permeable sections 530 providing an outlet 534. Due to the increased number of outlets and the ability of the flow to continue through one outlet while sand is accumulating against another outlet, production through the flow control chamber 536*a* may continue at a higher rate and for a longer period of time. Additionally, as described elsewhere herein, the stepped configuration and the provision of multiple outlets and flow paths may contribute to the formation of an internal natural sand pack by the infiltrated sand that may allow the production of fluids to continue through flow control chamber 536*a* with reduced risk of sand infiltration into the production flow control conduit 526*c*. Still additionally, the stepped configuration 502 may promote prolonged production rates and prolonged production periods between workovers due to the proximity of the adjacent flow control chambers. As seen in FIG. 11B, when flow control chamber 536*a* is blocked or otherwise packed by sand, formation fluids that would otherwise enter chamber 536*a* are able to be redirected, with corresponding energy dissipation, to enter an adjacent flow control chamber by traveling circumferentially around the outer member or longitudinally along the outer member.

The above description provides numerous illustrations of flow control systems within the scope of the present invention. Each of the systems are representative of the variety of systems that may be developed within the scope, teaching, and claims of the present invention. Moreover, it should be understood that each of the features of the various implementations may be interchangeable between the various implementations. For example, the selectively opening outlets described in connection with FIGS. 6A-6F may be incorporated into any of the other implementations. The inlets and the outlets to the flow control chambers of the various implementations may be selectively opened in a variety of manners including, selective perforating, rupture disks, pressure-sensitive valves, sliding sleeves, RFID controlled flow devices, etc. Additionally or alternatively, as described in connection with several implementations, the inlets and/or outlets may be adapted to allow fluid communication while preventing sand infiltration in a variety of suitable manners, including wire-wrapped screen, perforations, mesh, varied-pitch wire-wrapped screens, etc., and may be provided in any combination of filtration degrees, including filtering different size particles, filtering similarly size particles, or both.

Additionally, as described in connection with FIG. 3, the flow control systems within the scope of the present disclosure may be assembled or constructed in a variety of manners, including construction or assembly before insertion into the well and assembly after the components are already run into the well. For example, the flow control systems may be manufactured as standalone completion equipment ready to be coupled to other lengths of production or injection tubing. Additionally or alternatively, the flow control systems may include flow control apparatus adapted to be run through production tubing that is already disposed in the well. Inserting a flow control apparatus into an already downhole tubular may be accomplished through the use of a variety of available rig equipment and systems. Depending on the condition of the downhole tubular and the configuration of the flow control apparatus, the tolerance between the flow control apparatus and the inner diameter of the tubular may vary. In some implementations, swellable material may be disposed in a suitable manner on the flow control apparatus to close the tolerances required during the running of the flow control apparatus into position. The swellable material may be activated or swelled in any suitable manner, such as practiced in other applications within the industry. Additionally or alternatively, the tolerance between the flow control apparatus and the inner diameter of the tubular member may be sufficiently small to not require swelling material to seal between the tubular and the flow control apparatus. In some implementations, the flow control apparatus may not be intended to create a perfect seal between the apparatus and the tubular. For example, the configuration of the flow control apparatus, the flow control conduits, and the flow control chambers may render the pressure loss between the apparatus and the tubular sufficiently small that the fluid flow would be negligible.

The flow control systems of the present invention provide improved protection or countermeasures against a variety of flow impairment mechanisms to allow operations to continue for a longer period of time. The redundant flow paths are adapted to allow operations to continue even when a section of the well is impaired, such as by virtue of excess sand production, by virtue of scaling, or by virtue of blocked inlets. Similarly, the redundant sandscreens to prevent sand infiltration allow prolonged production from a section of the well when formation sand is being produced. By incorporating both redundant flow paths and redundant sandscreens, multiple flow impairment mechanisms are countered with a single system, that in many implementations may be disposed in a well and allowed to respond autonomously without operator intervention.

In some implementations, the flow control conduits are adapted to direct the incoming fluids in a longitudinal direction before encountering a chamber-defining structural member that changes the fluid's direction to pass through an outlet. For example, the coaxial configuration of FIGS. 5A and 5B promotes longitudinal flow in the outer flow control conduit before redirecting the flow radially to pass into the inner flow control conduit. In other implementations, the flow control conduits are adapted to direct the flow radially followed by a one or more directional changes either longitudinally or circumferentially before entering the production flow. Still additionally, in some implementations, the incoming flow through the inlet may be directed circumferentially and/or helically (circumferentially and longitudinally) through on or more flow control conduits before encountering a chamber-defining structural member changing the direction of the flow to cause the fluid to pass through an outlet and into a production flow control conduit. For example, the multiple outlets of the stepped configuration described herein allows fluid to flow both longitudinally within a flow control chamber and circumferentially between flow control chambers before passing through an outlet into the production flow control conduit. Other implementations may include conduit-defining structural members and/or chamber-defining structural members in any suitable configuration. As just one of the variety of examples, conduit-defining structural members may be disposed helically around an inner tubular. The helically wrapped conduit-defining structural members may direct flow helically around the inner tubular until encountering a chamber-defining structural member that impedes the helical flow and directs the flow through an outlet to the production flow control conduit provided by the inner tubular. In some implementations, the chamber-defining structural members may be disposed transverse to the fluid flow direction imposed or encouraged by the flow control conduits.

Each of the implementations within the scope of the present invention may be adapted to suit a particular well or section of a well. For example, the number of flow control conduits and flow control chambers may be varied as well as the length, width, depth, direction, etc. of the conduits and chambers. While the permutations of conduit-defining structural members and chamber-defining structural members may be endless, engineers and operators may identify several that are more suited for use due to one or more of ease of manufacture, ease of use, effectiveness in preventing sand production, effectiveness in maintaining production rates, ability to customize configurations, etc. Each such permutation is within the scope of the present invention.

EXAMPLE

The flow control systems of the present invention were demonstrated in a laboratory wellbore flow model. The laboratory wellbore model for the flow control system had a 25 centimeter (10-inch) OD, 7.6 meter (25-foot) Lucite pipe to simulate an open hole or casing. The apparatus to test the completion equipment was positioned inside the Lucite pipe and includes a series of three tubing sections. The three tubing sections consisted of 1) a flow control system having a mechanically damaged input region in the outer member, 2) a flow control system having an intact input region in the outer member, and 3) a conventional screen having a mechanically damaged sandscreen. Each tubing section was 15 centimeters (6 inches) in diameter and 1.8 meters (6-feet) long. The flow control systems included a 91 centimeter (3-foot) long slotted liner and a 91 centimeter (3-foot) long blankpipe as the tubular or outer member. The flow control apparatus disposed within the flow conduits included a 7.5 centimeter (3-inch) OD, inner tubular (conduit-defining structural member), which consisted of a 1.2 meter (4-foot) long blankpipe and a 61 centimeter (2-foot) long wire-wrapped screen. The outer member and the inner tubular in the modeled flow control systems were concentric, following the exemplary coaxial configuration described above. During the test, water containing gravel sand was pumped into the annulus between the tubing assembly (completion system) and the Lucite pipe (open hole or casing).

The slurry (water and sand) first flowed through the annulus and into the damaged flow control system. The sand entering the damaged flow control system was retained and packed in the flow control chamber defined between the inner tubular and the outer member. The growing sand pack increased the flow resistance and slowed down the sand entering the damaged flow control system. As the sand entering the damaged flow control system was diminishing, the slurry (water and sand) was diverted further downstream to the adjacent undamaged flow control system. The gravel sand was packed in the annulus between the undamaged flow control system and the Lucite pipe. Since this flow control system was intact, the sand was retained by the inlet in the outer member. As the undamaged flow control system was externally packed, the slurry was diverted to the next damaged conventional screen. The sand flowed around and into the damaged conventional screen. Since the conventional screen was not equipped with any secondary or redundant means for control sanding infiltration, the sand continuously entered the eroded screen and could not be controlled.

The experiment illustrated the concepts of the flow control systems during the gravel packing portion of well completion operations. If part of the sand screen media is damaged during screen installation or eroded during gravel packing operations, a flow control system as described herein is able to retain gravel by secondary or redundant means to counter sand infiltration or other flow impairment to thereby enable continuation of normal gravel packing operations. However, a conventional screen could not control gravel loss and would potentially cause an incomplete gravel pack. The incomplete gravel pack with a conventional screen later causes formation sand production during well production. Excessive sand production reduces well productivity, damages downhole equipment, and creates a safety hazard on the surface.

This experiment also illustrated the concepts underlying the flow control systems of the present invention during well production in gravel packed completion or stand-alone completion. If part of the screen media intended to prevent sand infiltration is damaged or eroded during well production, a flow control system as described herein can 1) retain gravel or natural sand (e.g., formation sand) in the flow control chambers of the flow control systems, 2) maintain the annular gravel pack or natural sand pack integrity, 3) divert flow to other intact screens, and 4) continue sand-free production. In contrast, a damaged conventional screen will cause a continuous loss of gravel pack sand or natural sand pack followed by continuous formation sand production.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A well flow control system comprising:

a tubular adapted to be disposed in a well to define a well annulus, wherein the tubular has an outer member defining an internal flow conduit, and wherein at least a portion of the outer member is permeable allowing fluid communication between the well annulus and the flow conduit; and a flow control apparatus adapted to be disposed within the flow conduit of the tubular, wherein the flow control apparatus comprises at least one conduit-defining structural member and at least one chamber-defining structural member; wherein the at least one conduit-defining structural member is configured to divide the flow conduit into at least three flow control conduits; wherein the at least one chamber-defining structural members is configured to divide at least two of the at least three flow control conduits into at least two flow control chambers; wherein each of the at least two flow control chambers has at least one inlet and at least one outlet; wherein each of the at least one inlet and the at least one outlet is adapted to allow fluids to flow therethrough and to retain particles larger than a predetermined size; and wherein at least one of the at least three flow control conduits is in fluid communication with the well annulus only through one or more of the flow control chambers.

2. The well flow control system of claim 1, wherein the flow control chambers in adjacent flow control conduits are fluidically offset and in fluid communication.

3. The well flow control system of claim 1, wherein fluid flow through an outlet of a flow control chamber formed in a first flow control conduit passes into a second flow control conduit.

4. The well flow control system of claim 1, wherein the retention of particles larger than a predetermined size by the outlet progressively increases resistance to flow through the outlet from the flow control chamber until fluid flow through the outlet is at least substantially blocked.

5. The well flow control system of claim 1, wherein the at least two flow control chambers are disposed within the flow conduit of the tubular such that fluid flow entering through the permeable portion of the outer member passes into at least one flow control chamber.

6. The well flow control system of claim 5, wherein the at least one inlet to the flow control chamber is provided by the permeable portion of the outer member of the tubular.

7. The well flow control system of claim 1, wherein the at least one inlet to the flow control chamber is adapted to retain particles of a first predetermined size and wherein the at least one outlet from the flow control chamber is adapted to retain particles of a second predetermined size.

8. The well flow control system of claim 1, wherein the at least one inlet and the at least one outlet of the flow control chamber are adapted to retain particles having at least substantially similar predetermined sizes; and wherein the flow control chamber is adapted to progressively retain particles larger than the predetermined size of the at least one outlet in the event that the at least one inlet is impaired.

9. The well flow control system of claim 1, wherein the at least one inlet and the at least one outlet for at least one of the flow control chambers are fluidically offset and in fluid communication.

10. The well flow control system of claim 1, wherein the flow within at least one of the flow control chambers is at least substantially longitudinal; and wherein the at least one chamber-defining structural member is disposed at least substantially transverse to the longitudinal direction.

11. The well flow control system of claim 1, wherein the flow within at least one of the flow control chambers is at least substantially circumferential; and wherein the at least one chamber-defining structural member is disposed at least substantially transverse to the circumferential direction.

12. The well flow control system of claim 1 wherein each of the at least one outlets is adapted to be selectively opened to control fluid flow through the outlet.

13. The well flow control system of claim 1 wherein at least one of the at least two flow control chambers includes at least two outlets, wherein each of the at least two outlets is adapted to retain particles of different predetermined sizes, and wherein each of the at least two outlets is adapted to be selectively opened to fluid flow to selectively retain particles of different predetermined sizes depending on which outlet is opened.

14. The well flow control system of claim 1 wherein the inlet to at least one flow control chamber is formed in the flow control apparatus; and wherein the outlet from the at least one flow control chamber is formed by the permeable portion of the outer member.

15. The well flow control system of claim 1 wherein the permeable portion of the outer member provides an inlet to at least one flow control chamber; and wherein the outlet from the at least one flow control chamber is formed in the flow control apparatus.

16. The well flow control system of claim 1 wherein the flow control apparatus is adapted to be run in a tubular disposed in a well.

17. The well flow control system of claim 1 wherein the at least one conduit-defining structural member is adapted to provide at least one non-permeable diversion surface one or more of the flow control chambers, wherein the non-permeable diversion surface is disposed in a direct fluidic path of the inlet to the flow control chamber such that incoming fluid is diverted.

18. The well flow control system of claim 17 wherein each flow control chamber includes at least two outlets each of which are fluidically offset from the inlet.

19. The well flow control system of claim 18 wherein each of the at least two outlets provides fluid communication with a different flow control conduit.

20. A flow control apparatus adapted for insertion into a flow conduit of a well tubular, the flow control apparatus comprising:

at least one conduit-defining structural member adapted to be inserted in a flow conduit of a well tubular and to divide the flow conduit into at least three flow control conduits;

at least two chamber-defining structural member configured to divide at least two of the at least three flow control conduits into at least two flow control chambers; and at least one permeable region provided in at least one of the at least one conduit-defining structural member and the at least two chamber-defining structural members; wherein the at least one permeable region is adapted to allow fluid communication and to retain particles larger than a predetermined size; wherein fluids flowing through the at least one permeable region pass from a first flow control conduit to a second flow control conduit within the flow conduit; and wherein at least one of the at least three flow control conduits is adapted to be in fluid communication with a well annulus only through one or more of the flow control chambers.

21. The flow control apparatus of claim 20 wherein the flow control apparatus is adapted to be run into a well tubular disposed in a well.

22. The flow control apparatus of claim 20 further comprising swellable materials disposed at least on the at least one conduit-defining structural member and adapted to at least substantially seal against the well tubular to fluidically isolate the at least two flow control conduits from each other such that flow between flow control conduits occurs at least substantially only through the at least one permeable region.

23. The flow control apparatus of claim 20 wherein the at least one permeable region is adapted to be selectively opened to control the particle size being filtered from the flow through the permeable region.

24. The flow control apparatus of claim 20, wherein the flow control chambers in adjacent flow control conduits are fluidically offset and in fluid communication.

25. The flow control apparatus of claim 20, used in a method to control particulate flow in hydrocarbon well equipment, the method comprising:

providing a tubular adapted for downhole use in a well, wherein the tubular comprises an outer member defining a flow conduit, and wherein at least a portion of the outer member is permeable and allows fluid flow through the outer member;

providing at least one flow control apparatus comprising: a) at least one conduit-defining structural member adapted to be disposed in the flow conduit of the tubular and to divide the flow conduit into at least three flow control conduits; and b) at least two chamber-defining structural member configured to divide at least two of the at least three flow control conduits into at least two flow control chambers;

disposing the tubular in a well;

disposing the at least one flow control apparatus in the well;

operatively coupling the at least one flow control apparatus with the tubular; wherein the operatively coupled tubular and at least one flow control apparatus comprise the at least three flow control conduits and the flow control chambers; wherein each of the flow control chambers has at least one inlet and at least one outlet; wherein each of the at least one inlet and the at least one outlet is adapted to allow fluids to flow therethrough and to retain particles larger than a predetermined size; and flowing fluids through the at least one flow control apparatus and the tubular.

26. The method of claim 25 wherein the permeable portion of the outer member provides at least one inlet to at least one flow control chamber; and wherein flowing fluids through the at least one flow control apparatus and the tubular comprises flowing production fluids through the permeable portion of the outer member and through the outlets of the flow control chambers to produce hydrocarbons from the well.

27. The method of claim 25 further comprising operatively coupling the at least one flow control apparatus and the tubular before disposing said at least one flow control apparatus and the tubular in the well.

28. The method of claim 25 wherein flowing fluids through the at least one flow control apparatus and the tubular comprises:

flowing fluid into at least one flow control chamber disposed in a first flow control conduit through at least one inlet, wherein the fluid flows through the at least one inlet in a first flow direction;

redirecting the fluid within the flow control chamber to flow in a second flow direction; and redirecting the fluid within the flow control chamber to flow in a third flow direction to pass through the at least one outlet and into a second flow control conduit.

29. The method of claim 28 wherein the second flow direction is at least one of substantially longitudinal, circumferential, radial, and helical.

30. The method of claim 25 wherein flowing fluids through the at least one flow control apparatus and the tubular comprises injecting at least one of stimulation fluids, produced fluids, drilling fluids, completion fluids, and gravel pack fluids into the well.

* * * * *